US011278946B2

(12) United States Patent
Linder et al.

(10) Patent No.: US 11,278,946 B2
(45) Date of Patent: Mar. 22, 2022

(54) MULTI-AXIS ROLL-FORMING METHODS, SYSTEMS, AND PRODUCTS

(71) Applicant: Inno-Spin LLC, Phillipsburg, NJ (US)

(72) Inventors: Maximilian Linder, Phillipsburg, NJ (US); Brian Ford, Moseley, VA (US); James Myers, Chesterfield, VA (US)

(73) Assignee: Inno-Spin LLC, Phillipsburg, NJ (US)

( * ) Notice: Subject to any disclaimer, the term of this patent is extended or adjusted under 35 U.S.C. 154(b) by 189 days.

(21) Appl. No.: 16/585,991

(22) Filed: Sep. 27, 2019

(65) Prior Publication Data

US 2020/0101511 A1 Apr. 2, 2020

Related U.S. Application Data

(60) Provisional application No. 62/737,525, filed on Sep. 27, 2018.

(51) Int. Cl.
*B21D 22/16* (2006.01)
*B21D 5/08* (2006.01)

(52) U.S. Cl.
CPC ..... *B21D 5/08* (2013.01); *B21D 22/16* (2013.01)

(58) Field of Classification Search
CPC ..... B21D 19/03; B21D 19/046; B21D 22/14; B21D 22/16; B21D 22/18; B21D 19/02; B21D 19/04; B21D 19/06
USPC ..... 72/101, 105, 106, 80–86
See application file for complete search history.

(56) References Cited

U.S. PATENT DOCUMENTS 2,408,596 A * 10/1946 Bednar ..... B21D 41/045 72/69
3,685,475 A * 8/1972 Banks, Jr. ..... B21K 21/04 72/69
4,117,704 A * 10/1978 Nakache ..... B21D 19/046 72/83
6,161,410 A 12/2000 Shook et al.
(Continued)

FOREIGN PATENT DOCUMENTS

CN 106694665 A 5/2017
DE 102010000004 A1 7/2011
(Continued)

OTHER PUBLICATIONS

PCT/US2019/053483 International Search Report and Written Opinion dated Feb. 6, 2020, 10 pages.
(Continued)

*Primary Examiner* — Debra M Sullivan
(74) *Attorney, Agent, or Firm* — Lathrop GPM LLP

(57) ABSTRACT

A multi-axis roll-forming method includes simultaneously (a) spinning, about a rotation axis, a spin platter having placed thereon a ring encircling the rotation axis, (b) pressing at least one first roller against outward-facing surface of a first portion of the ring to press the first portion against an outward-facing surface of the spin platter, and (c) forcing a second roller against an outward-facing surface of a second portion of the ring to bend toward the rotation axis the second portion, so as to form a lip extending toward the rotation axis, wherein the step of forcing includes (i) pivoting the second roller against the second portion, and (ii) translating the second roller along the second portion toward the rotation axis.

20 Claims, 21 Drawing Sheets

(56) References Cited

U.S. PATENT DOCUMENTS

| | | | | |
|---|---|---|---|---|
| 6,199,419 | B1 * | 3/2001 | Shrayer | B21D 22/16 72/69 |
| 7,121,128 | B2 * | 10/2006 | Kato | B21D 22/16 72/68 |
| 8,533,957 | B2 | 9/2013 | Spurlock et al. | |
| 8,726,708 | B2 | 5/2014 | Sato et al. | |
| 8,763,438 | B2 | 7/2014 | Sato et al. | |
| 9,669,445 | B2 * | 6/2017 | Nillies | B21D 22/21 |
| 2012/0317814 | A1 * | 12/2012 | Spurlock | B21C 37/0811 29/898.11 |
| 2017/0274443 | A1 | 9/2017 | Kobayashi et al. | |

FOREIGN PATENT DOCUMENTS

| | | | |
|---|---|---|---|
| JP | 3264613 | B2 | 3/2002 |
| KR | 10-0929221 | B1 | 12/2019 |

OTHER PUBLICATIONS

PCT/US2019/053493 International Search Report and Written Opinion dated Feb. 24, 2020, 11 pages.
PCT/US2019/053483 Invitation to Pay Additional Fees dated Nov. 14, 2019, 2 pages.
PCT/US2019/053493 Invitation to Pay Additional Fees dated Nov. 14, 2019, 2 pages.

* cited by examiner

MULTI-AXIS ROLL-FORMING METHODS, SYSTEMS, AND PRODUCTS

CROSS-REFERENCE TO RELATED APPLICATIONS

The present application claims the benefit of priority from U.S. Provisional Application Ser. No. 62/737,525 filed Sep. 27, 2018, which is incorporated herein by reference in its entirety.

BACKGROUND

The metalworking industry is striving toward producing metal parts that are stronger, lighter, more accurate, and cheaper. Roll-forming is one method that has proven advantageous in this regard. Roll forming uses a set of rollers to bend thin metal to achieve a desired shape. Most commonly, a coil of sheet metal is fed into a roll-forming machine that, as the coil is advanced through the machine, forces a series of rollers against the coil to change its shape. In a simple example, rollers are pressed against the sides of a coil to change the profile of the coil from planar to u-shaped. More advanced shapes may be imparted using other roller configurations. The roll-formed coil may be cut into sections of a desired length. In some instances, two ends of a section are joined to make a roll-formed ring.

Roll-forming may be entirely automated and performed at a high throughput rate, thus resulting in low manufacturing cost. In addition, since roll-forming works the metal in a cold state, the roll-formed parts are generally stronger than hot-worked parts made from metal of similar thickness. For example, roll-forming may be superior to extrusion in terms of strength of the finished part. As a result, a roll-formed part may be made from thinner metal and yet be as strong as a similar part made by extrusion, which leads to savings in material cost as well as lighter finished parts.

SUMMARY

In an embodiment, a multi-axis roll-forming method include comprising simultaneously performing steps of (a) spinning, about a rotation axis, a spin platter having placed thereon a ring encircling the rotation axis, (b) pressing at least one first roller against outward-facing surface of a first portion of the ring to press the first portion against an outward-facing surface of the spin platter, and (c) forcing a second roller against an outward-facing surface of a second portion of the ring to bend toward the rotation axis the second portion, so as to form a lip extending toward the rotation axis. The step of forcing includes pivoting the second roller against the second portion, and translating the second roller along the second portion toward the rotation axis.

In an embodiment, a ring produced by multi-axis roll-forming includes a sidewall encircling a cylinder axis of the ring. The sidewall has height along the cylinder axis from a bottom end of the sidewall to a top end of the sidewall. The ring further includes a lip encircling and extending toward the cylinder axis to define an aperture of smaller diameter than the top end. The lip has a bottom surface facing space enclosed by the sidewall. The bottom surface is planar or conical. The ring also includes an edge connecting the lip and the top end. The ring has mono-directional curvature from the top end, around the edge, and along at least a portion of the lip. The sidewall, the lip, and the edge are respective portions of a single continuous part.

In an embodiment, a multi-axis roll-forming system includes a spin platter that is configured to spin about a rotation axis while holding a workpiece. The spin platter has (a) an outward-facing surface facing away from the rotation axis, and (b) a top surface characterized by a surface normal that is parallel to the rotation axis or at an oblique angle to the rotation axis. The multi-axis roll-forming system further includes at least one support roller positioned radially outward from the outward-facing surface. Each support roller is configured to press a first portion of the workpiece against the outward-facing surface. The multi-axis roll-forming system also includes a form roller configured to pivot toward the top surface and translate parallel to the top surface, to bend a second portion of the workpiece against the top surface while the spin platter is spinning the workpiece.

DETAILED DESCRIPTION OF THE EMBODIMENTS

Figure 1:
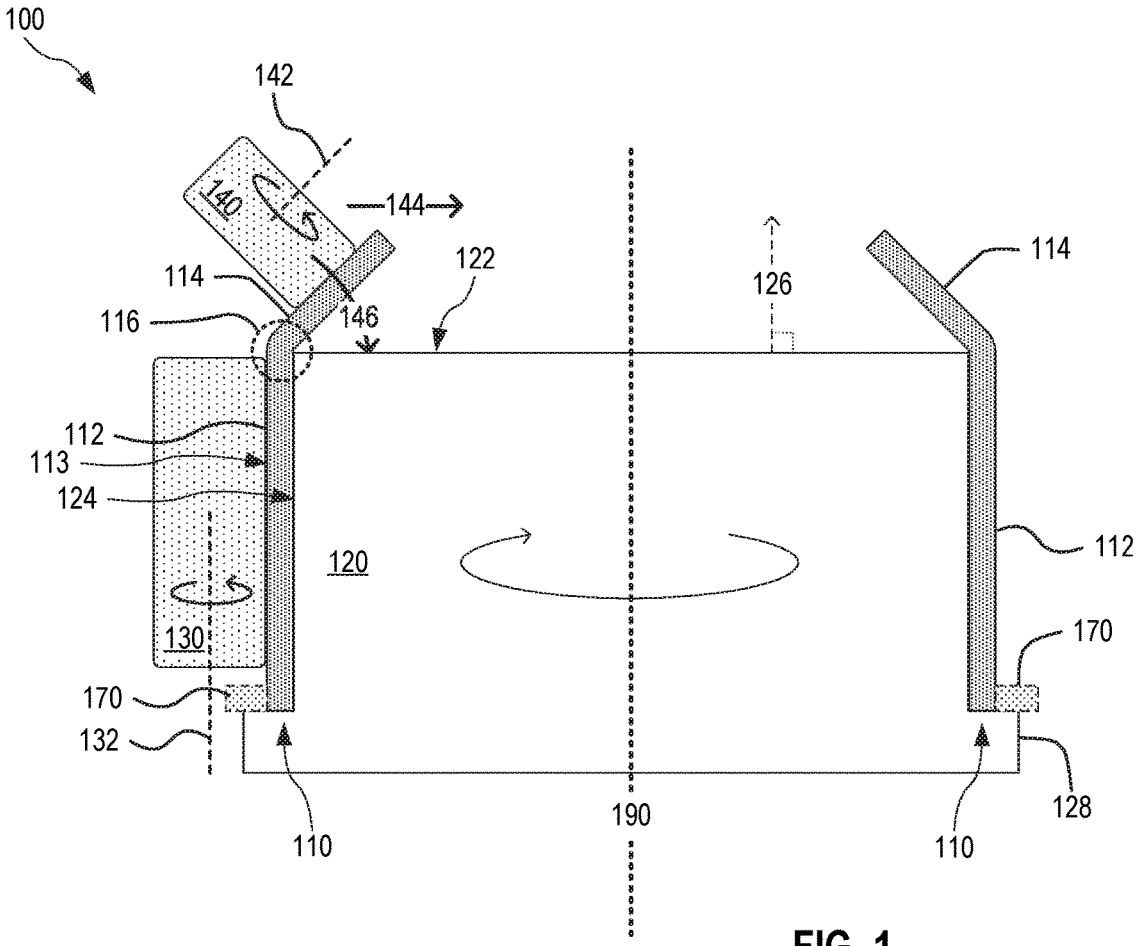
FIGS. 1 and 2 illustrate a multi-axis roll-forming system configured to modify the shape of a ring-shaped workpiece by roll-forming, according to an embodiment.
Figure 2:
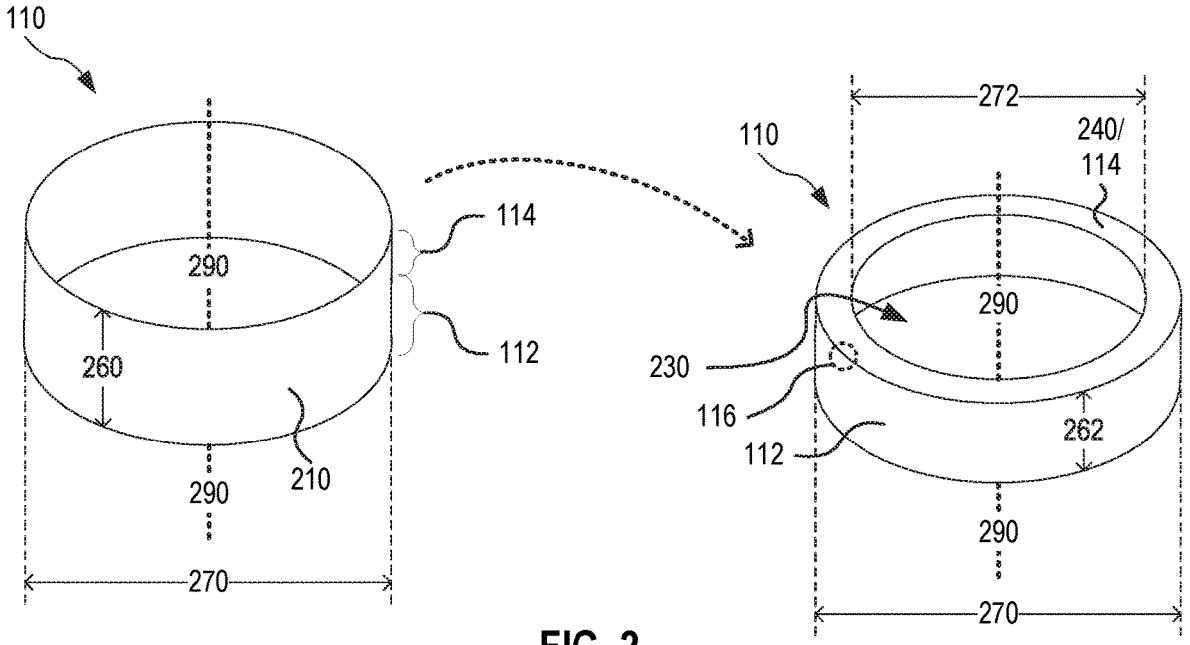

FIGS. 1 and 2 illustrate one multi-axis roll-forming system 100 configured to modify the shape of a ring-shaped workpiece 110 by roll-forming. FIG. 1 depicts multi-axis roll-forming by system 100 in cross sectional view, and FIG. 2 is a perspective view of workpiece 110 before and after being subjected to multi-axis roll-forming by system 100. FIGS. 1 and 2 are best viewed together in the following description. Workpiece 110 may be made of metal or another material that is bendable by roll-forming. Herein, a "ring-shaped workpiece" such as workpiece 110 refers to a part that encircles a cylinder axis and has shape that is symmetric with respect to rotation about the cylinder axis. In one use scenario, system 100 roll-forms a bearing seal case from a cylindrical ring. In another use scenario, system 100 is one of several systems in a manufacturing line that combines the multi-axis roll-forming performed by system 100 with one or more other modifications of workpiece 110 to form a bearing seal case. This bearing seal case is, for example, configured to seal a roller bearing of a train car axle. System 100 is, however, not limited to roll-forming of bearing seal cases and may be applied to roll-forming of other parts. Regardless of the intended use of workpiece 110, system 100 provides several benefits. In addition to enabling the manufacture of cheaper, stronger, and lighter parts through the use of roll-forming, system 100 is specifically configured to use multi-axis roll-forming to achieve improved control of the shape of workpiece 110.

Workpiece 110 includes a sidewall 210 that encircles a cylinder axis 290 of workpiece 110. In an embodiment, sidewall 210 is parallel to cylinder axis 290. Sidewall 210 has height 260 and outer diameter 270. System 100 bends an upper portion 114 of sidewall 210 radially inwards toward cylinder axis 290 to form a lip 240. Lip 240 defines an aperture 230 having diameter 272. Diameter 272 is less than diameter 270. After formation of lip 240, a portion of sidewall 210 remains as a sidewall 112 of height 262. Without departing from the scope hereof, workpiece 110 may include additional portions. For example, workpiece 110 may extend beyond sidewall 210/112 at the lower end of sidewall 210/112 in FIGS. 1 and 2. FIG. 1 shows one such example, wherein workpiece extends radially outward at the lower end of sidewall 112 to form a flange 170.

System 100 includes a spin platter 120, one or more support rollers 130, and a form roller 140. Spin platter 120 and support roller(s) 130 cooperate to spin workpiece 110 with spin platter 120 and secure workpiece 110. While workpiece 110 is spinning, system 100 bends workpiece 110 by forcing form roller 140 against workpiece 110 in both a pivoting motion and a translation motion. This multi-axis functionality, associated with both pivoting and translation, enables improved control of the shape of workpiece 110 at the bend, as compared to what may be achieved with single-axis motion. The multi-axis functionality may also be utilized to roll-form more complex features in workpiece 110.

Spin platter 120 is configured to spin about a rotation axis 190 while at least partly supporting workpiece 110. Spin platter 120 has a radially-outward-facing surface 124 and a top surface 122. Radially-outward-facing surface 124 faces away from rotation axis 190. Top surface 122 is either perpendicular to rotation axis 190 (as shown in FIG. 1) or at an oblique angle to rotation axis 190. In other words, a normal vector 126 to top surface 122 is either parallel to rotation axis 190 (as shown in FIG. 1) or at an oblique angle to rotation axis 190. Spin platter 120 may include a flange 128 that helps support workpiece 110 on spin platter 120.

Each support roller 130 is positioned radially outward, relative to rotation axis 190, from radially-outward-facing surface 124 and is configured to press a portion of sidewall 210 against radially-outward-facing surface 124. System 100 may be configured with only a single support roller 130. Alternatively, system 100 is configured with two or more support rollers 130 cooperatively configured to press a portion of sidewall 210 against radially-outward-facing surface 124. In embodiments with two of more support rollers 130, support rollers 130 may be positioned to all apply pressure generally from one side of workpiece 110, for example from the left in FIG. 1. In operation, spin platter 120 spins about rotation axis 190 and each support roller 130 presses a portion of workpiece 110 against radially-outward-facing surface 124, such that workpiece 110 spins with spin platter 120 and each support roller 130 spins about its rotation axis 132.

Form roller 140 is a multi-axis roller that is capable of both (a) pivoting toward top surface 122, as indicated by arrow 146, and (b) translating parallel to top surface 122 as indicated by arrow 144. It is understood that form roller 140 is further capable of pivoting away from top surface 122 in the direction opposite arrow 146, and translating parallel to top surface 122 in the direction opposite arrow 144, at least to ensure that form roller 140 can be brought back to its starting position and/or to allow for removal of workpiece 110 from system 100. In operation, while workpiece 110 spins with spin platter 120 and engages with support roller (s) 130, system 100 forces form roller 140 against upper portion 114 of sidewall 210 to bend upper portion 114 against top surface 122 and form lip 240. While form roller 140 is forced against workpiece 110, the spinning of workpiece 110 causes form roller 140 to spin about its rotation axis 142. As mentioned above, system 100 is configured to force form roller 140 against upper portion 114 by both pivoting and translating form roller 140. In one use scenario, system 100 simultaneously pivots and translates form roller 140. In another use scenario, system 100 pivots and translates form roller 140 at different respective times during the roll-forming process.

Figure 3A:
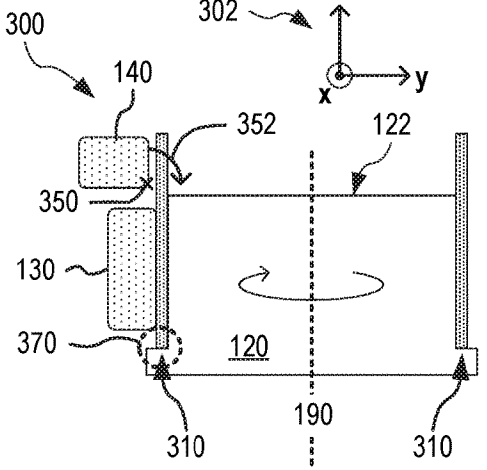
FIGS. 3A-C illustrate a method for single-axis roll-forming of a ring-shaped workpiece, according to an embodiment.
Figure 3B:
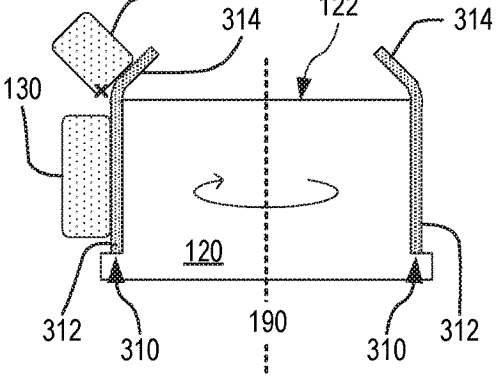
Figure 3C:
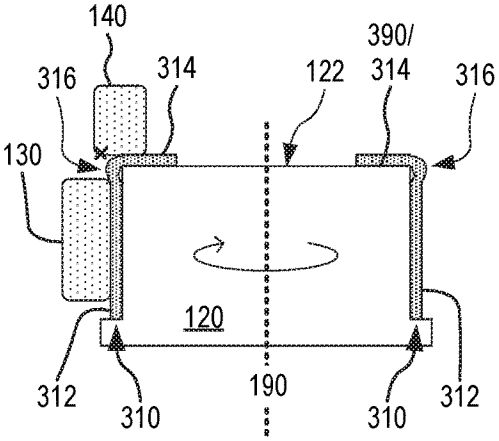

FIGS. 3A-C illustrate one method 300 for single-axis roll-forming of a ring-shaped workpiece 310. Workpiece 310 is similar to workpiece 110. Method 300 is representative of roll-forming by system 100 when system 100 restricts the motion functionality of form roller 140 to pivoting only. FIG. 3A shows an initial configuration prior to commencing single-axis roll-forming. FIG. 3B shows an intermediate configuration partway through the single-axis roll-forming process. FIG. 3C shows the configuration upon completion of single-axis roll-forming. FIGS. 3A-C are best viewed together in the following description.

In the single-axis roll-forming process of method 300, form roller 140 is capable of pivoting, as indicated by arrow 352, about a pivot axis 350. (Pivot axis 350 is indicated by a cross in each of FIGS. 3A-B.) However, the position of pivot axis 350 is fixed. Using coordinate system 302 as a reference, spin platter 120 spins in the x-y plane, and form roller 140 pivots in the y-z plane. Pivot axis 350 is parallel to the x-axis. In method 300, spin platter spins about rotation axis 190, one or more support rollers 130 engage with workpiece 310 and help secure workpiece 310 while workpiece 310 spins with spin platter 120. Simultaneously with these actions by spin platter 120 and support roller(s) 130, form roller 140 pivots and bends workpiece 310. Starting from the initial configuration in FIG. 3A, form roller 140 pivots about pivot axis 350 and begins to bend an upper portion 314 of workpiece 310 toward top surface 122 (see FIG. 3B) until upper portion 314 is pressed against top surface 122 (see FIG. 3C) and forms a lip 390. Throughout this process, the position of pivot axis 350 remains stationary. With the restricted motion of form roller 140 associated with single-axis roll-forming, the edge 316 between upper portion 314 and the remaining sidewall 312 of workpiece 310 frequently suffers from imperfections. Frequently, edge 316 bulges radially outward. Another common imperfection is variation, across different copies of workpiece 310, in the material thickness around edge 316 from sidewall 312 to lip 390. In addition, a single workpiece 310 may exhibit variation in the material thickness of edge 316 as a function of the azimuthal position relative to rotation axis 190.

Without departing from the scope hereof, the extend of workpiece 310 may be greater than what is shown in FIGS. 3A-C. For example, workpiece 310 may extend beyond the lower end 370 shown in FIGS. 3A-B and form, e.g., a flange extending radially outward from lower end 370, a stepped diameter cylinder extending radially outward and downward from lower end 370, or another shape.

Figure 4A:
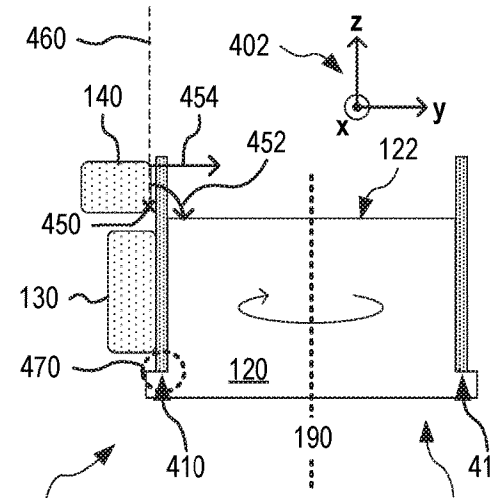
FIGS. 4A-C illustrate a method for multi-axis roll-forming of a ring-shaped workpiece performed by the system of FIG. 1, according to an embodiment.
Figure 4B:
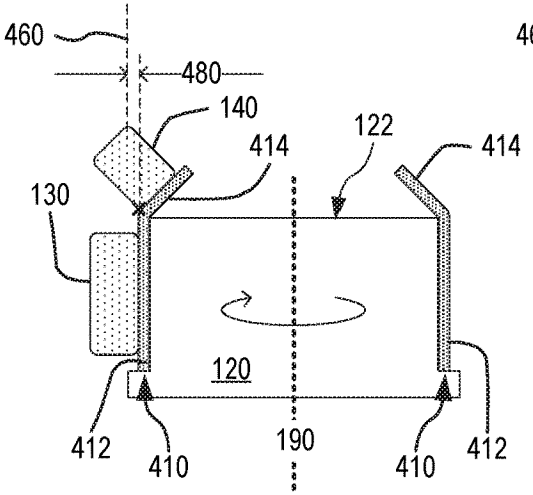
Figure 4C:
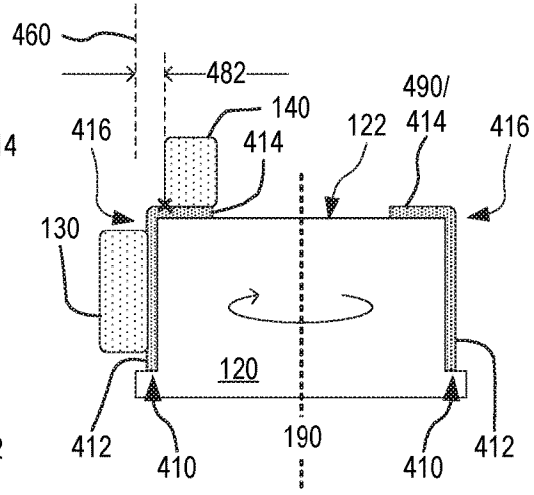

FIGS. 4A-C illustrate one method 400 for multi-axis roll-forming of a ring-shaped workpiece 410 performed by system 100. Workpiece 410 is similar to workpiece 110. FIG. 4A shows an initial configuration prior to commencing single-axis roll-forming. FIG. 4B shows an intermediate configuration partway through the single-axis roll-forming process. FIG. 4C shows the configuration upon completion of single-axis roll-forming. FIGS. 4A-C are best viewed together in the following description.

As compared to method 300, method 400 not only pivots form roller 140 about a pivot axis 450, but also translates form roller 140 (together with pivot axis 450) toward rotation axis 190. Pivot axis 450 is indicated by a cross in each of FIGS. 4A-C. Arrows 452 and 454 indicate the pivoting and translation, respectively, of form roller 140. The translation takes place in a direction parallel to the y-axis of coordinate system 402. In method 400, spin platter spins about rotation axis 190, one or more support rollers 130 engage with workpiece 410 and help secure workpiece 410 while workpiece 410 spins with spin platter 120. Simultaneously with these actions by spin platter 120 and support roller(s) 130, form roller 140 pivots and translates to bend workpiece 410. Starting from the initial configuration in FIG. 4A, form roller 140 pivots about pivot axis 450 and translates toward rotation axis 190. The translation results in a displacement 480 of pivot axis 450 from its initial position 460 toward rotation axis 190. The pivoting and translation cooperate to begin bending an upper portion 414 of workpiece 410 in the direction toward top surface 122 (see FIG. 4B). Method 400 continues to pivot and translate form roller 140 until upper portion 414 is pressed against top surface 122 (see FIG. 4C) to form a lip 490. Between the initial configuration shown in FIG. 4A and the final configuration shown in FIG. 4C, pivot axis 450 translates by a total amount 482.

By virtue of the multi-axis motion functionality of form roller 140, method 400 provides improved control of the properties of edge 416, between lip 414 and the remaining sidewall 412, as compared to method 300. For example, translation of form roller 140 may help prevent edge 416 from bulging radially outward.

Without departing from the scope hereof, the extend of workpiece 410 may be greater than what is shown in FIGS. 4A-C. For example, workpiece 410 may extend beyond the lower end 470 shown in FIGS. 4A-B and form, e.g., a flange extending radially outward from lower end 470, a stepped diameter cylinder extending radially outward and downward from lower end 470, or another shape.

Figure 5:
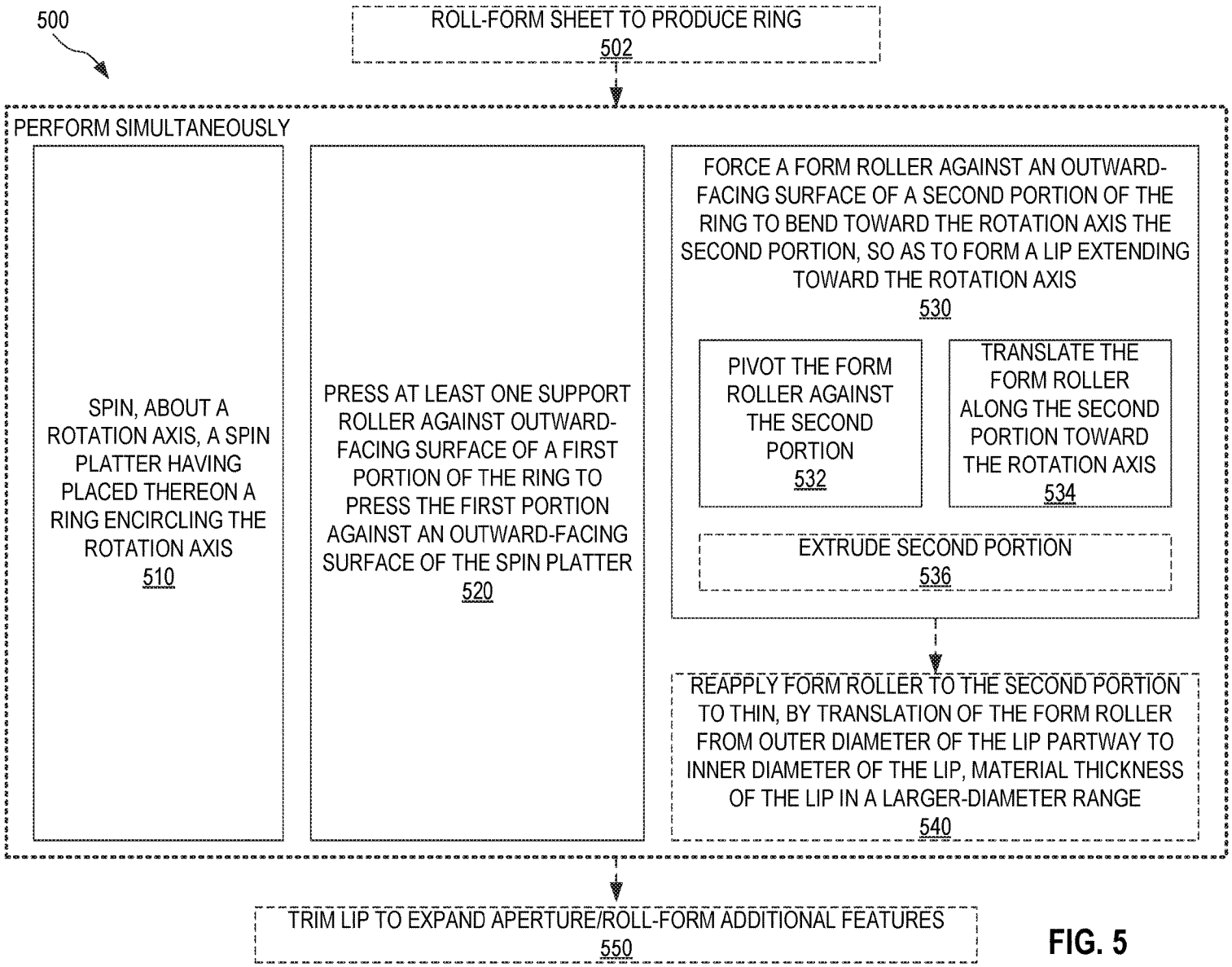
FIG. 5 is a flowchart for a method for multi-axis roll-forming of a ring-shaped workpiece, according to an embodiment.

FIG. 5 is a flowchart for one method 500 for multi-axis roll-forming of a ring-shaped workpiece. Method 500 may be performed by system 100. Method 400 is an example of method 500. Method 500 simultaneously performs steps 510, 520, and 530.

Step 510 spins a spin platter about a rotation axis. The spin platter has a ring-shaped workpiece placed thereon. In one example of step 510, spin platter 120 spins about rotation axis 190 while workpiece 110 is situated on spin platter 120. Step 520 presses at least one support roller against the radially-outward-facing surface of a first portion of the workpiece, thereby pressing the first portion of the workpiece against a radially-outward-facing surface of the spin platter. Since step 520 is performed simultaneously with step 510, each support roller rolls with the spinning motion of workpiece, and the first portion of the workpiece is a part of the workpiece that spans a certain extent along the rotation axis and encircles the rotation axis of the spin platter. In one example of step 520, system 100 presses one or more support rollers 130 against radially-outward-facing surface 113 of sidewall 112, so as to press sidewall 112 against radially-outward-facing surface 124 of spin platter 120 (see FIG. 1).

In one embodiment, the diameter of the radially-outward-facing surface of the spin platter, against which the support roller(s) presses the first portion of the workpiece, is slightly undersized relative to the inner diameter of the first portion of the workpiece. In this embodiment, the pressure applied by the support roller(s) in step 520 may help secure the workpiece to the spin platter such that the workpiece spins together with the spin platter in step 510.

Step 530 forces a form roller against the radially-outward-facing surface of a second portion of the workpiece to bend this second portion radially inward toward the rotation axis, so as to form a lip that extends toward the rotation axis. Step 530 is performed while the workpiece is spinning, as effectuated by step 510 optionally in cooperation with step 520. Thus, the second portion of the workpiece is a part of the workpiece that encircles the rotation axis of the spin platter and, prior to step 530, spans a certain extent along the rotation axis. Step 530 reduces the extent of the second portion of the workpiece along the rotation axis. In one example of step 530, system 100 forces form roller 140 against upper portion 114 of workpiece 110 to bend upper portion 114 toward rotation axis 190 to form lip 240.

Whether the diameter of the radially-outward-facing surface of the spin platter (against which the support roller(s) presses the first portion of the workpiece in step 520) is undersized or matches the inner diameter of the first portion of the workpiece, the support roller(s) may help ensure that the first portion of the workpiece is unaltered by step 530.

Step 530 applies multi-axis roll-forming by performing steps 532 and 534. Step 532 pivots the form roller against the second portion of the workpiece. In one example of step 532, system 100 pivots form roller 140 in the direction indicated by arrow 146 in FIG. 1. Step 534 translates the form roller toward the rotation axis. In one example of step 534, system 100 translates form roller 140 in the direction indicated by arrow 144 in FIG. 1.

In one embodiment, step 530 performs steps 532 and 534 simultaneously. For example, in FIGS. 4A-C, form roller 140 may simultaneously pivot and translate to change the shape of workpiece 410 from its initial configuration shown in FIG. 4A to the configuration shown in FIG. 4C.

In another embodiment, step 530 first performs step 532 until the form roller is at a desired orientation. Next, while keeping the form roller at this desired orientation, step 530 performs step 534 to translate the form roller toward the rotation axis. For example, in a modified version of the process shown in FIGS. 4A-C. In this modified version, pivot axis 450 remains stationary until form roller 140 has pivoted to the orientation shown in FIG. 4C. Subsequently, form roller 140 translates from an initial position, characterized by pivot axis 450 being at its initial position 460, toward rotation axis 190 until pivot axis 450 is displaced by the amount 482.

In yet another embodiment, step 530 alternates between performing an increment of step 532 and performing an increment of step 534. For example, in FIGS. 4A-C, form roller 140 may alternate between (a) pivoting by an incremental amount and (b) translating by an incremental amount.

As compared to method 300, the multi-axis motion functionality cooperatively provided by steps 532 and 534, method 500 provides improved control of the properties of the edge between (a) the lip formed in step 530 and (b) the first portion of the workpiece that is pressed against the radially-outward-facing surface of the spin platter in step 520. For example, the translation in step 534 may help prevent this edge form bulging radially outward. In one scenario, step 530 pivots and translates the form roller (e.g., form roller 140) such that the edge between the lip and the first portion does not bulge outwards. For example, workpiece 110 may, after having been subjected to steps 510, 520, and 530, have mono-directional curvature along edge 116 from sidewall 112 to lip 240 (see FIGS. 1 and 2). Herein, "mono-directional curvature" refers to the mathematical curvature not changing sign, such that the curvature always points inwards toward the space enclosed by sidewall 112. When the edge (e.g., edge 116) has mono-directional curvature, the edge forms neither a radially outward bulge nor an upward bulge (e.g., in the upwards direction parallel to rotation axis 190 in FIGS. 1 and 2). In this scenario, the form roller (e.g., form roller 140) pivots and translates such that the edge (e.g., edge 116) (a) does not extend to greater distance from the rotation axis than the original shape of the first portion (e.g., sidewall 112), and (b) does not extend beyond the lip (e.g., lip 240) in the direction from the first portion to the second portion (e.g., upper portion 114) along the rotation axis. In another scenario, step 530 pivots and translates the form roller (e.g., form roller 140) to prevent the edge (e.g., edge 116) from bulging radially outward, such that the edge does not extend to greater distance from the rotation axis than the original shape of the first portion (e.g., sidewall 112). In yet another scenario, step 530 pivots and translates the form roller (e.g., form roller 140) to prevent the edge (e.g., edge 116) from bulging upward in the direction along the rotation axis, such that the edge does not extend beyond the lip (e.g., lip 240) in the direction from the first portion to the second portion along the rotation axis.

The multi-axis functionality of step 530 also enables additional manipulation of the workpiece. For example, system 100 may extrude upper portion 114 by translation of form roller 140 in the direction toward rotation axis 190. System 100 may apply such translation of form roller 140 to uniformly thin the material of upper portion 114 when forming lip 240. Alternatively, system 100 may apply translation of form roller 140 to locally thin a section of upper portion 114 that is further from rotation axis 190 without thinning a remaining section of upper portion 114 that is closer to rotation axis 190.

In an embodiment, method 500 further includes a step 502 of producing the ring-shaped workpiece that is subjected to multi-axis roll-forming by steps 510, 520, and 530. Step 502 roll-forms a sheet to produce one or more instances of the workpiece. The sheet is made of metal or another material that is bendable by roll-forming and can be joined to form a ring.

Figure 6:
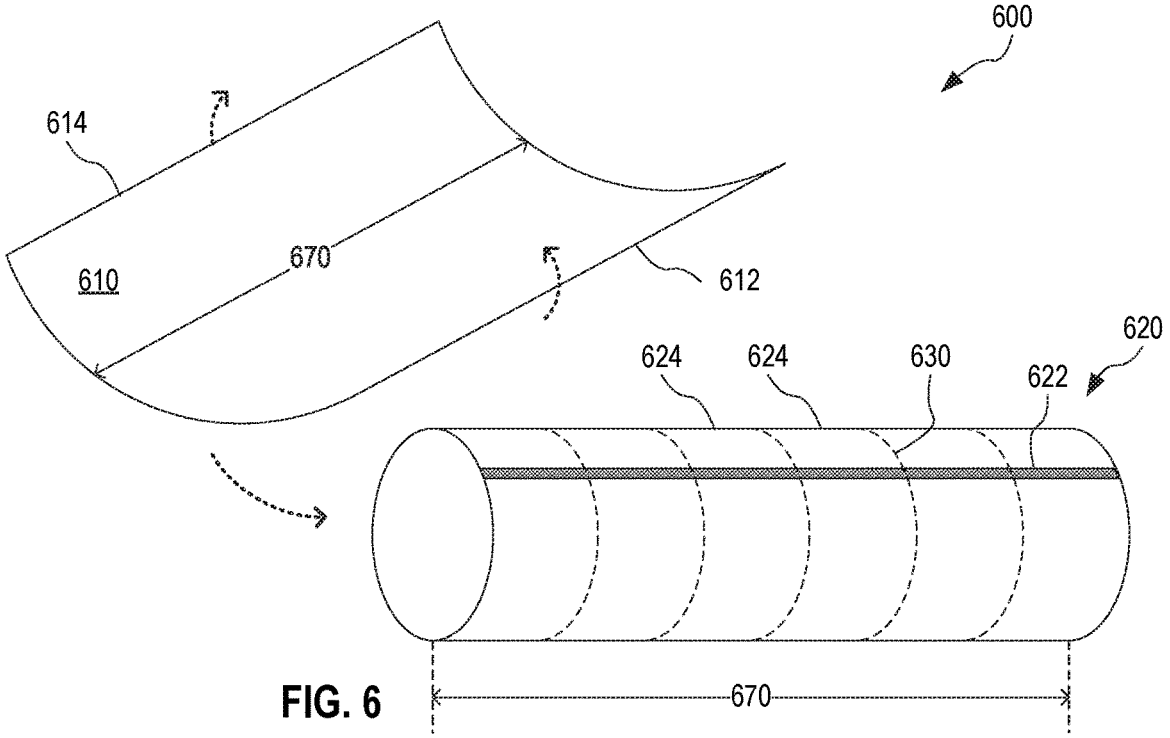
FIG. 6 illustrates a method for roll-forming one or more rings from a sheet, according to an embodiment.

FIG. 6 illustrates one method 600 for roll-forming one or more rings from a sheet, such as a metal sheet. Method 600 is an example of step 502 of method 500. Method 600 roll-forms a sheet 610 to join together two opposite sides 612 and 614 of sheet 610, so as to form a cylinder 620. Sides 612 and 614 may be joined by welding, thus resulting in cylinder 620 having a weld seam 622. Although not shown in FIG. 6, method 600 may include a step of removing extraneous material from weld seam 622, such that the surfaces of cylinder 620 are substantially smooth across weld seam 622.

Cylinder 620 has length 670. Length 670 matches the length of each of sides 612 and 614. In one embodiment, length 670 is sufficient to form multiple shorter rings 624 by cutting cylinder 620 at lines 630. In another embodiment, length 670 matches the desired axial extent of the ring, and method 600 does not cut cylinder 620.

Referring again to FIG. 5, method 500 may include, after step 502 and before steps 510, 520, and 530, one or more additional steps to modify the shape of the workpiece formed in step 502 prior to multi-axis roll-forming in steps 510, 520, and 530, without departing from the scope hereof.

In one example, method 500 forms flange 170 extending radially outward from the lower end of sidewall 112 in FIG. 1, or a stepped diameter cylinder extending radially outward and downward from the lower end of sidewall 112.

In certain embodiments, step 530 includes a step 536 of extruding the material of the second portion of the workpiece. For example, step 530 may pivot the form roller in step 532 to press the form roller against the second portion with sufficient force that the translation of the form roller in step 534 extrudes the material of the second portion toward the rotation axis. The extrusion in step 536 may be tuned to achieve a desired thickness of the lip. This desired thickness may be uniform across the lip, or vary as a function of distance from the rotation axis. In one example of step 536, system 100 pivots form roller 140 against upper portion 114 with sufficient force that the material of upper portion 114 is extruded during translation of form roller 140 toward rotation axis 190.

Method 500 may further include a step 550 of making additional modifications to the workpiece after completion of steps 510, 520, and 530. Step 550 trims the lip to expand the aperture formed by the lip and/or roll-forms additional features in the workpiece. In embodiments of method 500 that include step 536, step 550 may trim excess material extruded toward the rotation axis in step 536. However, step 550 may also be implemented in embodiments of method 500 that do not include step 536 or any other extrusion of the lip.

Figure 7:
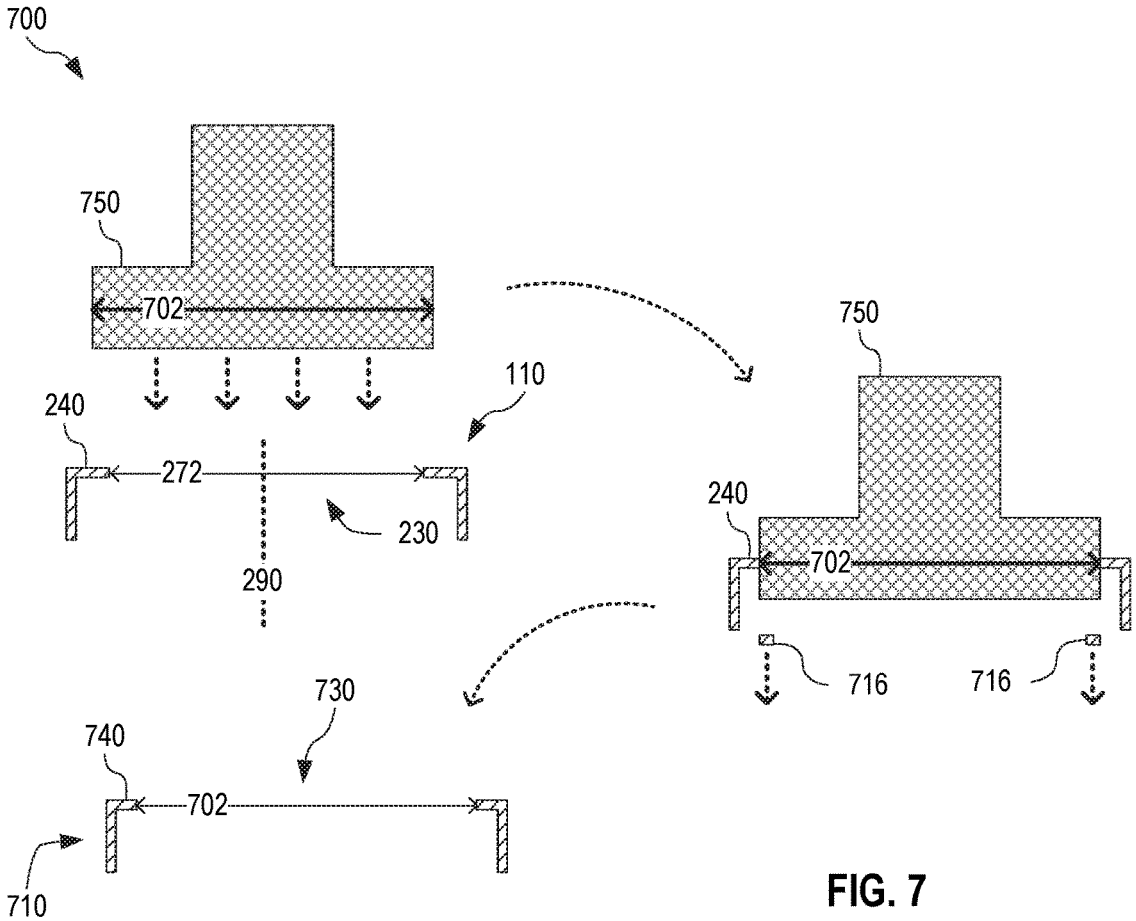
FIG. 7 illustrates a method for trimming an aperture formed by a lip of a ring-shaped workpiece, according to an embodiment.

FIG. 7 illustrates one method 700 for trimming an aperture formed by a lip of a ring-shaped workpiece. Method 700 is an example step 550 of method 500. Method 700 receives workpiece 110 after multi-axis roll-forming of lip 240. Before initiation of method 700, lip 240 defines aperture 230 having diameter 272. Method 700 utilizes a stamp 750 having diameter 702. Diameter 702 is larger than diameter 272. Stamp 750 punches out an inner section 716 of lip 240 to form a modified ring-shaped workpiece 710 having a smaller lip 740 that defines a larger aperture 730 characterized by a diameter 702. Although not depicted in FIG. 7, it is understood that method 700 may utilize a support structure that supports workpiece 110 from the direction opposite the punching action by stamp 750.

Referring again to FIG. 5, aperture trimming in step 550 may relax the tolerance requirements to the size of the aperture defined by the lip formed in step 530. Aperture trimming in step 550 may thereby relax the tolerance requirements to one or both of (a) extrusion in step 536 and (b) the axial extent of the workpiece prior to multi-axis roll-forming in steps 510, 520, and 530.

In an embodiment, method 500 includes a step 540 of reapplying the form roller to the second portion after completion of step 530. Step 540 is performed simultaneously with steps 510 and 520. It is understood that steps 510 and 520 may pause between steps 530 and 540. Step 540 translates the form roller from the outer diameter of the lip partway to the inner diameter of lip, to thin the material thickness of the lip in a larger-diameter range.

Figure 8:
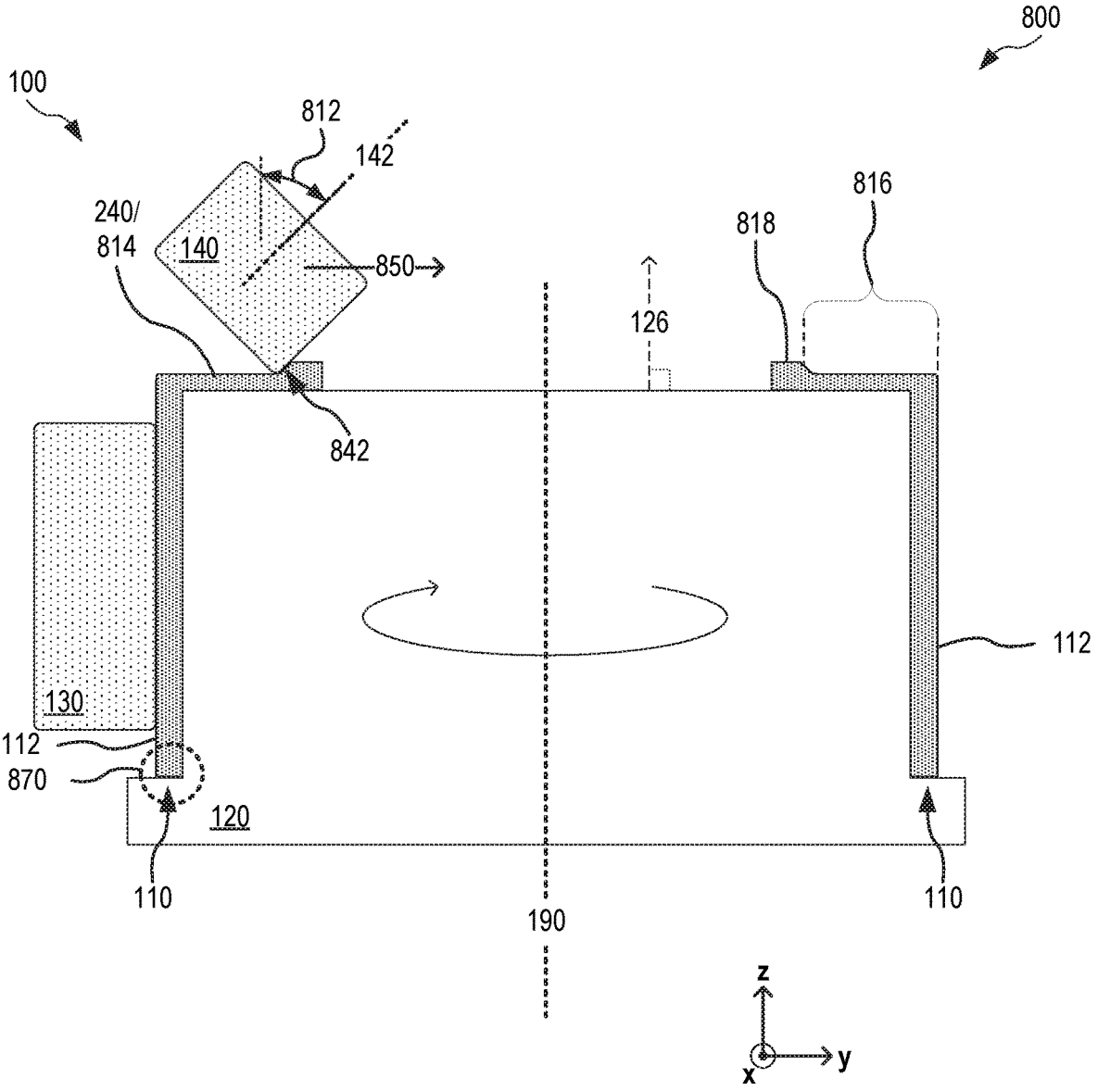
FIG. 8 illustrates a method for thinning a larger-diameter range of a lip of a ring-shaped workpiece, according to an embodiment.

FIG. 8 illustrates one method 800 for thinning a larger-diameter range of a lip of a ring-shaped workpiece. Method 800 is an example of step 540. Method 800 accepts, as input, workpiece 110 after formation of lip 240 in step 530 (in cooperation with steps 510 and 520). In method 800, system 100 orients form roller 140 with its rotation axis 142 at an oblique angle 812 to normal vector 126, and positions an edge 842 of form roller 140 radially outward from sidewall 112. While workpiece 110 spins with spin platter 120, method 800 translates form roller 140 toward rotation axis 190, as indicated by arrow 850, such that edge 842 thins the portion of lip 240 contacted by edge 842. Method 800 stops this translation of form roller 140 before edge 842 reaches the inner diameter of lip 240. As a result, method 800 forms a modified lip 814 that includes a larger-diameter section 816 and a ridge 818. Larger-diameter section 816 is thinner than ridge 818. The thickness of ridge 818 may exceeds the thickness of lip 240 prior to performing method 800.

In an alternate embodiment, method 800 continues the translation of form roller 140 across the entire radial extent of lip 240 to uniformly thin lip 240.

It is understood that workpiece 110 may extend beyond the lower end 870 of sidewall 112, as discussed above in reference to FIGS. 1 and 4.

Referring again to FIG. 5, an alternative embodiment of method 500 may achieve multi-axis roll-forming by omitting step 534 and instead implementing step 540 (optionally modified to uniformly thin the entire lip, as discussed above). Such an alternative embodiment of method 500 essentially corresponds to completing the pivoting motion of the form roller before initiating the translation motion.

In certain implementations of method 500, step 550 roll-forms additional features in the ring-shaped workpiece. Such roll-forming may be performed using the same rollers and/or spin platter as in steps 520 and 530, or using different rollers and/or spin platter. For example, step 550 may make additional bends in the sidewall of the workpiece and/or change the material thickness of a sidewall or a lip of the workpiece. The material thickness change may be local and for example result in the formation of ribs.

Figure 9:
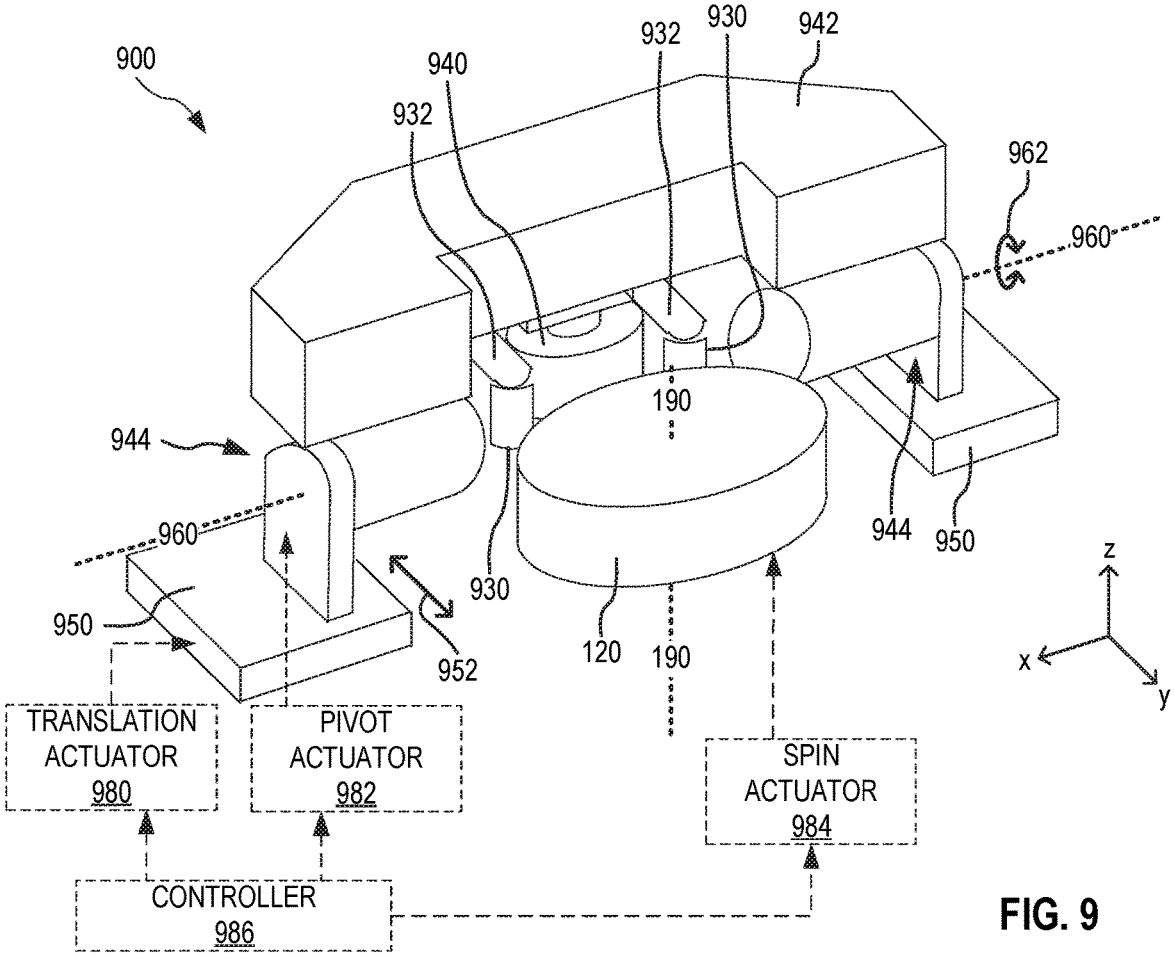
FIGS. 9 and 10 illustrate a multi-axis roll-forming system, according to an embodiment.
Figure 10:
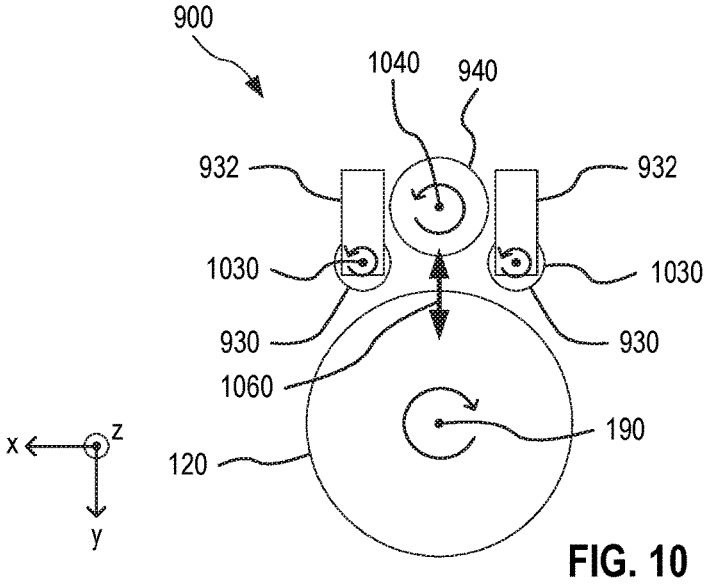

FIGS. 9 and 10 illustrate one multi-axis roll-forming system 900. System 900 is an embodiment of system 100. FIG. 9 is a perspective view of system 900, and FIG. 10 is a top view of certain parts of system 900. FIGS. 9 and 10 are best viewed together in the following description.

System 900 includes spin platter 120, two support rollers 930, two arms 932, and a form roller 940. Support rollers 930 are an embodiment of support rollers 130. Form roller 940 is an embodiment of form roller 140. Each support roller 930 is mounted on a respective arm 932. System 900 further includes a swing arm 942, two rotation joints 944, and a table 950. Form roller 940 is mounted to swing arm 942, and swing arm 942 is coupled to table 950 via rotation joints 944. Rotation joints 944 allow for pivoting of swing arm 942, and thereby form roller 940, about a pivot axis 960 as indicated by arrow 962. Table 950 is capable of translation relative to spin platter 120 and support rollers 930, as indicated by arrow 952. Since form roller 940 is coupled to table 950 via swing arm 942 and rotation joints 944, translation of table 950 results in translation of form roller 940 (also as indicated by arrow 952).

Support rollers 930 are mounted at two different azimuthal locations relative to rotation axis 190 of spin platter 120. Each support roller 930 is configured to rotate about a respective axis 1030. Form roller 940 is configured to rotate about a rotation axis 1040. Pivoting and translation of form roller 940, as indicated respectively by arrows 962 and 952 in FIG. 9, results in movement in the directions indicated by arrow 1060 in FIG. 10.

In an embodiment, system 900 further includes a translation actuator 980 and a pivot actuator 982. Translation actuator 980 drives translation of table 950, and pivot actuator 982 drives pivoting a swing arm 942. System 900 may also include a spin actuator 984 that drives spinning of spin platter 120. In one implementation, system 900 includes a controller 986 that controls actuation by translation actuator 980 and pivot actuator 982, and optionally also spin actuator 984. Alternatively, system 900 is configured to cooperate with a controller provided by a third party. Controller 986 may be configured to execute steps 510, 520, and 530, and optionally also step 540, of method 500.

Figure 11:
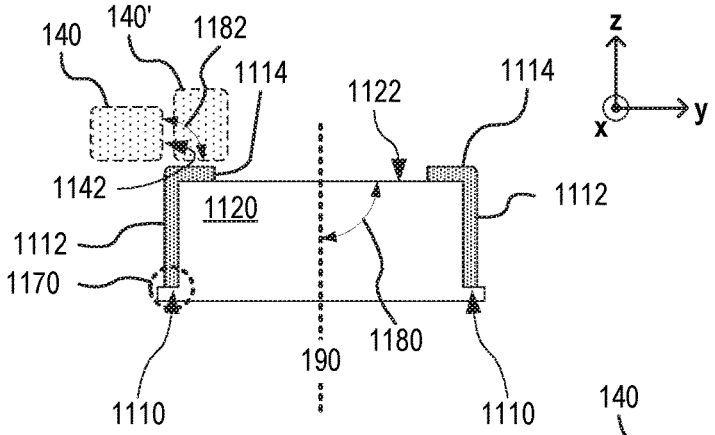
FIGS. 11-13 illustrate different example shapes of spin platter top surfaces and resulting ring-shaped workpieces.
Figure 12:
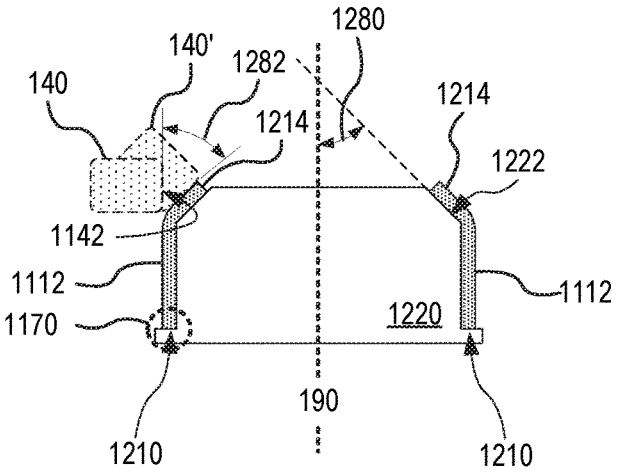
Figure 13:
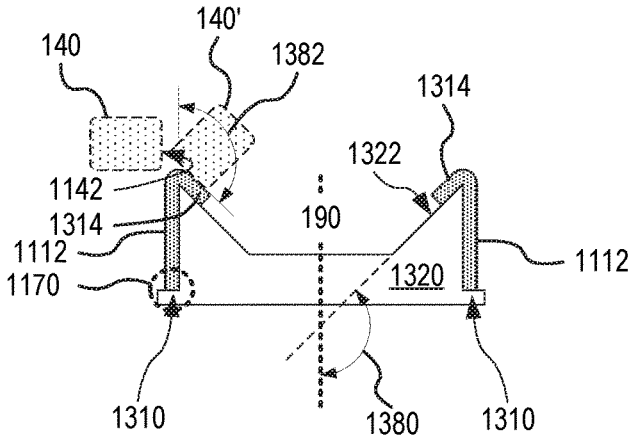

FIGS. 11-13 illustrate different example shapes of spin platter top surfaces and resulting ring-shaped workpieces formed when performing steps 510, 520, and 530 using these spin platter top surfaces. Each spin platter shown in FIGS. 11-13 is an embodiment of spin platter 120, and each workpiece shown in FIG. 11-13 is an embodiment of workpiece 110 after forming lip 240. For clarity of illustration, FIGS. 11-13 do not show support rollers 130, although it is understood that at least one support roller 130 is used in the multi-axis roll-forming of each workpiece.

FIG. 11 shows a ring-shaped workpiece 1110 formed by system 100 or 900 when performing steps 510, 520, and 530 of method 500 with a spin platter 1120. Spin platter 1120 includes a top surface 1122 that is at a right angle 1180 to rotation axis 190. When system 100 (or 900) implemented with spin platter 1120 performs step 530, form roller 140 presses an upper portion 1114 of workpiece 1110 against top surface 1122, such that the lip formed from upper portion 1114 is at right angles to a remaining sidewall 1112 of workpiece 1110. Sidewall 1112 and upper portion 1114 are examples of sidewall 112 and upper portion 114, respectively. It is understood that workpiece 1110 may extend beyond the lower end 1170 of sidewall 112, as discussed above in reference to FIGS. 1 and 4.

In the scenario depicted in FIG. 11, a work surface 1142 of form roller 140 is pivoted by an angle 1182 from being parallel to the radially-outward-facing surface of upper portion before initiation of step 530 to being parallel to top surface 1122 after completion of step 530 (as indicated by label 140'). In this scenario, angle 1182 is ninety degrees. However, without departing from the scope hereof, system 100/900 may stop the pivoting of form roller 140 in step 532 before work surface 1142 becomes parallel to top surface 1122, and system 100/900 may instead rely on translation in step 534 to complete the shaping of upper portion 1114 against top surface 1122. Alternatively, pivoting of form roller 140 may be halted before work surface 1142 becomes parallel to top surface 1122.

FIG. 12 shows a ring-shaped workpiece 1210 formed by system 100 or 900 when performing steps 510, 520, and 530 of method 500 with a spin platter 1220. Workpiece 1210 is similar to workpiece 1110 apart from having a different angle between the lip and remaining sidewall. Workpiece 1210 is formed in a manner similar to that discussed above in reference to FIG. 11, apart from using a different spin platter. Spin platter 1120 includes a top surface 1222 that is at an oblique angle 1280 to rotation axis 190. When system 100 (or 900) implemented with spin platter 1220 performs step 530, form roller 140 presses an upper portion 1214 of workpiece 1210 against top surface 1222, such that the lip formed from upper portion 1214 is at an obtuse angle to the remaining sidewall 1112 of workpiece 1110. That is, upper portion 1214 is deflected by less than ninety degrees. Sidewall 1112 and upper portion 1214 are examples of sidewall 112 and upper portion 114, respectively. In a scenario where work surface 1142 of form roller 140 is pivoted to being parallel with top surface 1222, form roller is pivoted by an angle 1282 that may be less than ninety degrees.

FIG. 13 shows a ring-shaped workpiece 1310 formed by system 100 or 900 when performing steps 510, 520, and 530 of method 500 with a spin platter 1320. Workpiece 1310 is similar to workpiece 1110 apart from having a different angle between the lip and remaining sidewall. Workpiece 1310 is formed in a manner similar to that discussed above in reference to FIG. 11, apart from using a different spin platter. Spin platter 1320 includes a top surface 1322 that is at an oblique angle 1380 to rotation axis 190. When system 100 (or 900) implemented with spin platter 1320 performs step 530, form roller 140 presses an upper portion 1314 of workpiece 1310 against top surface 1322, such that the lip formed from upper portion 1314 is at an acute angle to the remaining sidewall 1112 of workpiece 1110. That is, upper portion 1314 is deflected by more than ninety degrees. Sidewall 1112 and upper portion 1314 are examples of sidewall 112 and upper portion 114, respectively. In a scenario where work surface 1142 of form roller 140 is pivoted to being parallel with top surface 1322, form roller is pivoted by an angle 1382 that is more than ninety degrees.

Figure 14:
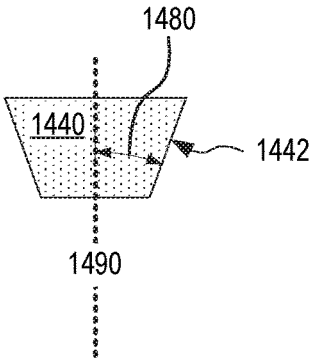
FIG. 14 illustrates a form roller that may be implemented in the system of FIG. 1, according to an embodiment.

FIG. 14 illustrates one form roller 1440 that may be implemented in system 100 as form roller 140 or in system 900 as form roller 940. Form roller 1440 has a work surface 1442 facing radially outward from the rotation axis 1490 of form roller 1440. The angle 1480 between work surface 1442 and rotation axis 1490 may be in the range between zero and forty-five degrees. In one embodiment, angle 1480 is zero degrees, such that work surface 1442 is parallel to rotation axis 1490. In another embodiment, angle 1480 is greater than zero degrees, for example in the range between five and forty-five degrees. When system 100 or 900 implements an embodiment of form roller 1440 characterized by angle 1480 being greater than zero degrees, system 100/900 may initiate step 532 of method 500 with rotation axis 1490 being non-parallel to rotation axis 190 of spin platter 120. Embodiments of form roller 1440 characterized by angle 1480 being greater than zero degrees may be mounted in system 100/900 such that, when form roller 1440 is pivoted toward rotation axis 190, (a) a greater diameter portion of form roller 1440 is closer to rotation axis 190, or (b) a smaller diameter portion of form roller 1440 is closer to rotation axis 190.

Figure 15:
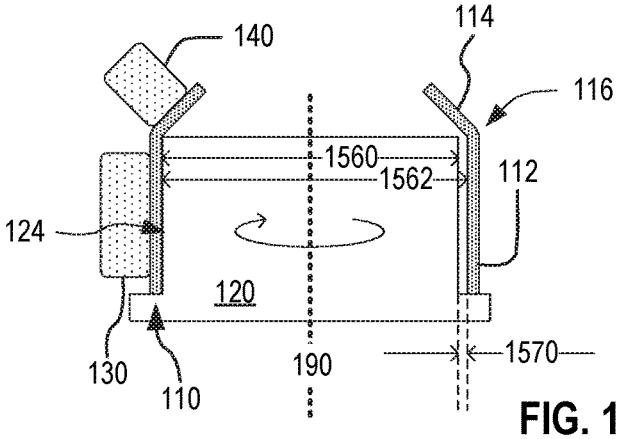
FIG. 15 illustrates an embodiment of the method of FIG. 5 that uses a spin platter having undersized radial extent.

FIG. 15 illustrates one embodiment of method 500 that uses a spin platter having radial extent 1560 undersized relative to the inner diameter 1562 of sidewall 112. When support roller(s) 130 presses sidewall 112 against radially-outward-facing surface 124 of spin platter 120, a gap 1570 exists between sidewall 112 and radially-outward-facing surface 124 at least in portion of the 360 degree azimuthal range about rotation axis 190. Such undersizing of spin platter 120 relative to workpiece 110 may further improve the control over the shape of edge 116, by removing a constraint otherwise imposed by a spin platter being sized to match the inner diameter of sidewall 112.

Figure 16:
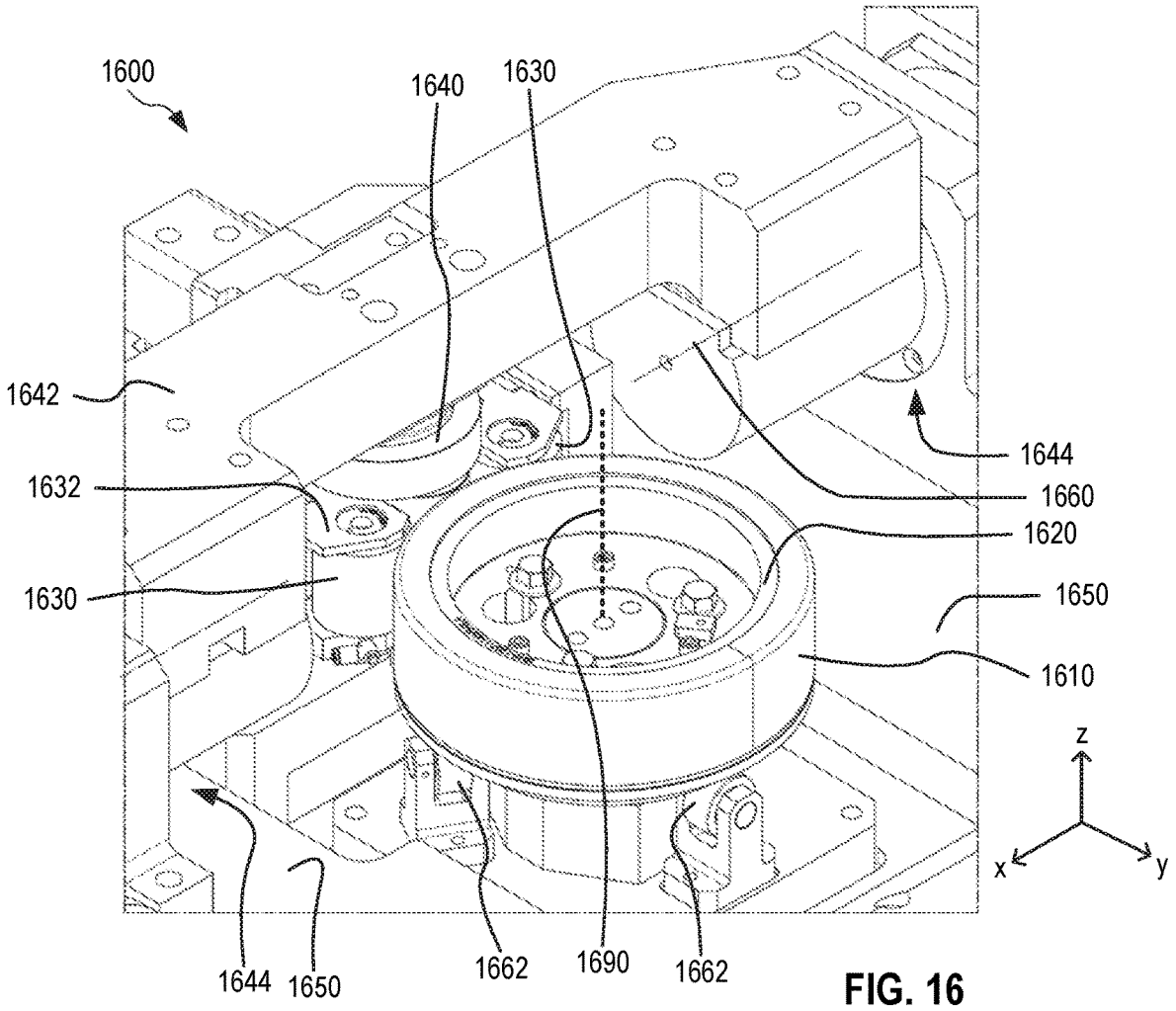
FIGS. 16 and 17 illustrate another multi-axis roll-forming system, according to an embodiment.
Figure 17:
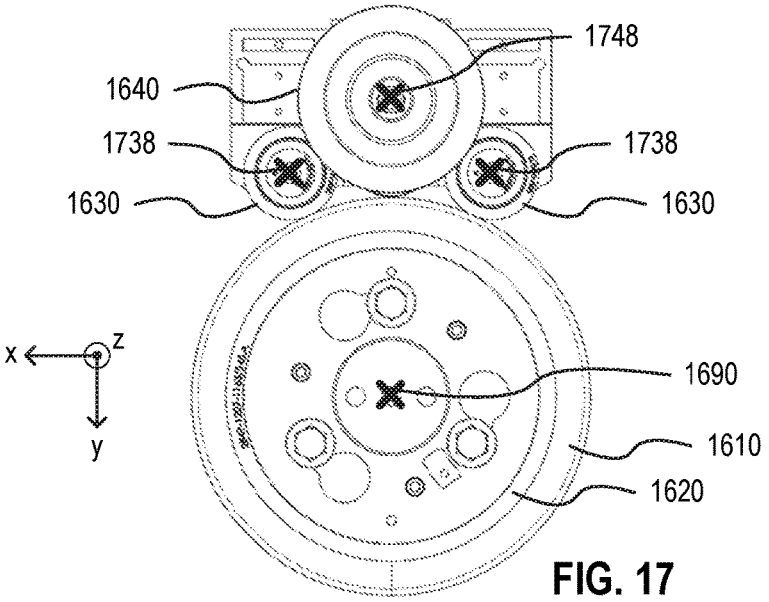

FIGS. 16 and 17 illustrate another multi-axis roll-forming system 1600. System 1600 is an embodiment of system 900. FIG. 16 is a perspective view of a system 1600, and FIG. 17 is a top view of a certain elements of system 1600. FIGS. 16 and 17 are best viewed together in the following description.

System 1600 includes spin platter 1620, two support rollers 1630, two arms 1632, and a form roller 1640. FIGS. 16 and 17 depict system 1600 with a workpiece 1610 mounted on spin platter 1620. FIGS. 16 and 17 show spin platter 1620 after having been subjected to multi-axis roll-forming by system 1600. Support rollers 1630 are an embodiment of support rollers 930. Form roller 1640 is an embodiment of form roller 940. Each support roller 1630 is mounted on a respective arm 1632 (an embodiment of arm 932). System 1600 further includes a swing arm 1642, two rotation joints 1644, and a table 1650 (embodiments of swing arm 942, rotation joints 944, and table 950, respectively).

In a manner similar to that discussed for system 900, spin platter 1620 is configured to spin about a rotation axis 1690, each support roller 1630 is configured to rotate about a respective axis 1738, and form roller 1640 is configured to rotate about a rotation axis 1748. Swing arm 1642 is configured to pivot about an axis 1660, to pivot form roller 1640. Spin platter 1620 is at least partly supported by a set of rollers 1662.

Although not shown in FIGS. 16 and 17, system 1600 may further include one or more of translation actuator 980, pivot actuator 982, spin actuator 984, and controller 986.

Figure 18:
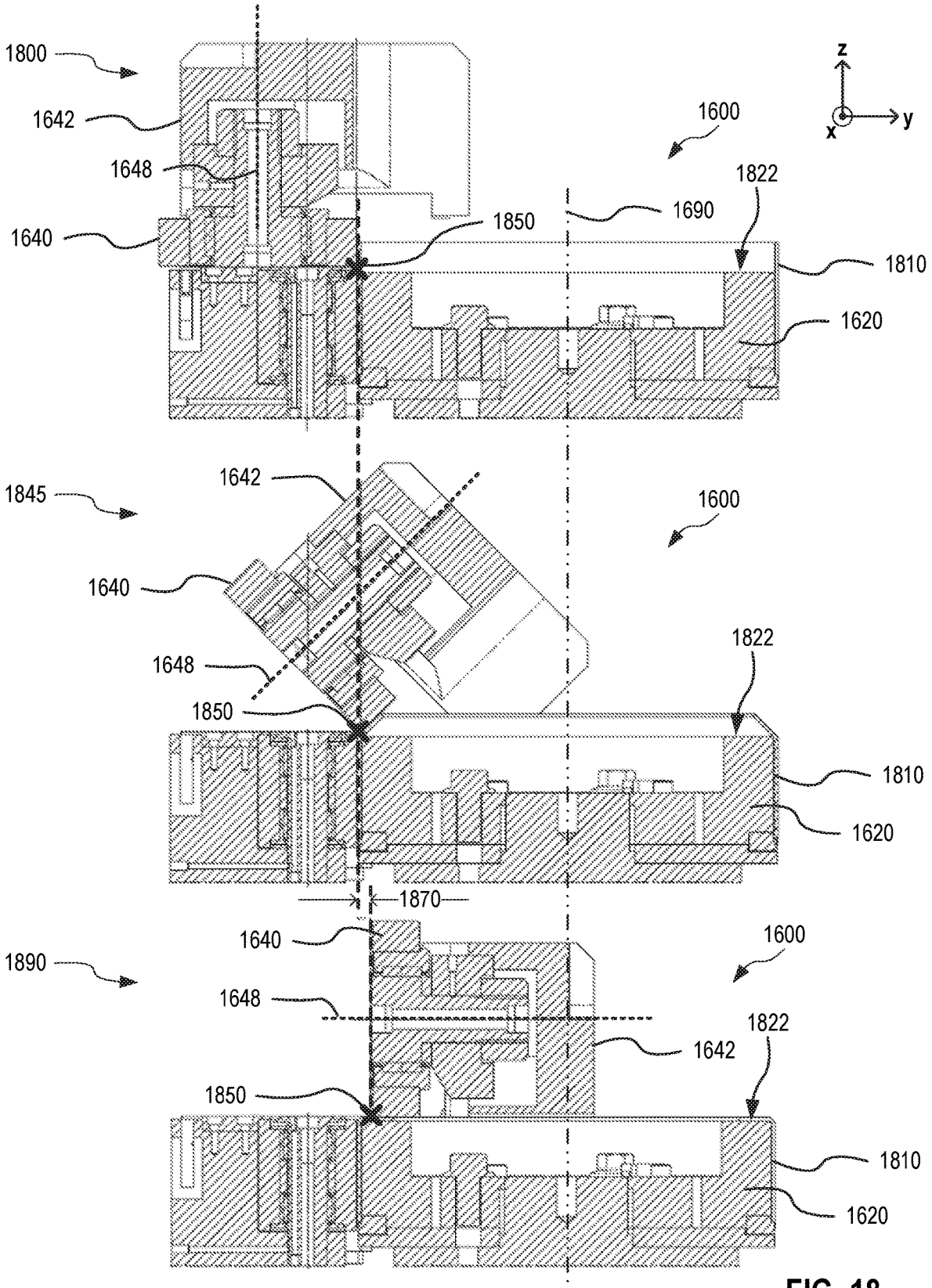
FIG. 18 illustrates use of the system of FIGS. 16 and 17, according to an embodiment.

FIG. 18 illustrates use of system 1600 to perform an embodiment of steps 510, 520, and 530, to multi-axis roll-form a ring-shaped workpiece 1810. Workpiece 1810 is an example of workpiece 110. Three diagrams 1800, 1845, and 1890 show, in sectional side view, the position of swing arm 1642 and form roller 1640 at three different respective times during step 530.

Diagram 1800 shows the configuration of system 1600 upon initiation of step 530. At this time, table 1650 and swing arm 1642 cooperate to position form roller 1640 against an upper portion of workpiece 1810. Since the radially-outward-facing work surface of form roller 1640 is parallel to rotation axis 1648 of form roller 1640, rotation axis 1648 is parallel to rotation axis 1690 at this time.

At the time associated with diagram 1845, system 1600 has performed a portion of step 532. More specifically, system 1600 has, with the use of swing arm 1642, pivoted form roller 1640 to bend the upper portion of workpiece 1810 toward rotation axis without bending the upper portion all the way to the top surface 1822 of spin platter 1620.

Diagram 1890 shows the final configuration of system 1600 upon completion of step 530. At this time, system 1600 has completed an example of the pivoting of step 532 and also performed an example of step 534. In this example of step 534, system 1600 has used table 1650 to translate form roller toward rotation axis 1690. This translation corresponds to a displacement of the pivot axis 1850 of form roller 1640 by an amount 1870.

Figure 19:
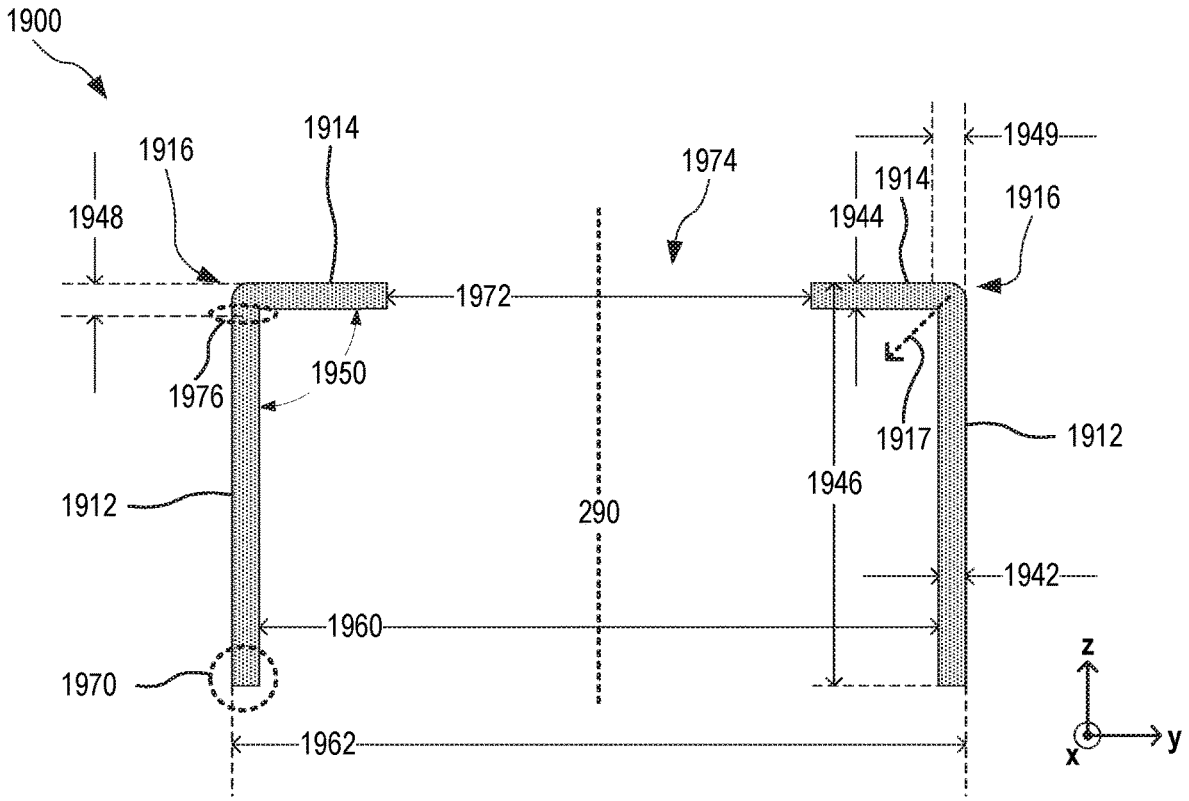
FIG. 19 illustrates a ring-shaped workpiece formed the method of FIG. 5, according to an embodiment.

FIG. 19 illustrates one ring-shaped workpiece 1900 formed by steps 510, 520, and 530 of method 500, with optional trimming in step 550. Workpiece 1900 is an embodiment of workpiece 110 after being subject to multi-axis roll-forming to form lip 240. Workpiece 1900 may be formed by system 100. Workpiece 1900 includes a cylindrical sidewall 1912, a lip 1914 that extends from a top end 1976 of sidewall 1912 toward cylinder axis 290 of sidewall 1912, and an edge 1916 that connects lip 1914 to the top end of sidewall 1912. Each of sidewall 1912, lip 1914, and edge 1916 encircles cylinder axis 290. Lip 1914 defines an aperture 1974 that has diameter 1972. Diameter 1972 is smaller than the inner diameter 1960 of sidewall 1912. Sidewall 1912, lip 1914, and edge 1916 are different portions of a single continuous part, optionally including a weld seam as discussed above in reference to FIG. 6. Without departing from the scope hereof, workpiece 1900 may extend beyond the lower end 1970 of sidewall 1912, as discussed above in reference to FIGS. 1 and 4.

The angle 1950 between lip 1914 and sidewall 1912 may be ninety degrees, such that lip 1914 is planar and perpendicular to cylinder axis 290. Alternatively, angle 1950 may be greater than or less than ninety degrees, such that lip 1914 is conical.

Sidewall 1912 has thickness 1942, and lip 1914 has thickness 1944. Each of thickness 1942 and 1944 are between 0.5 and 10 millimeters, for example, and the outer diameter 1962 of sidewall 1912 may be in the range between 1 and 30 inches. Height 1946 may be in the range between 0.25 inches and 36 inches, and in an embodiment, thickness 1944 is uniform across lip 1914. In another embodiment, thickness 1944 deviates from thickness 1942 by no more than 10 percent. In yet another embodiment, thickness 1944 is uniform across lip 1914 and thickness 1944 deviates from thickness 1942 by no more than 10 percent. In a further embodiment, material thickness of sidewall 1912, lip 1914, and edge 1916 is uniform to within 10 percent. In another embodiment, thickness 1944 is less than thickness 1942.

In certain embodiments, the curvature 1917 of edge 1916 is mono-directional such that edge 1916 does not bulge outwards in the radial or axial directions. In such embodiments, (a) the extent 1948 of edge 1916 along cylinder axis 290 is bounded by the extent, along cylinder axis 290, between top end 1976 of sidewall 1912 and the top of lip 1914, and (b) the extent 1949 of edge 1916 in dimensions perpendicular to cylinder axis 290 is bounded by diameter 1962.

Figure 20:
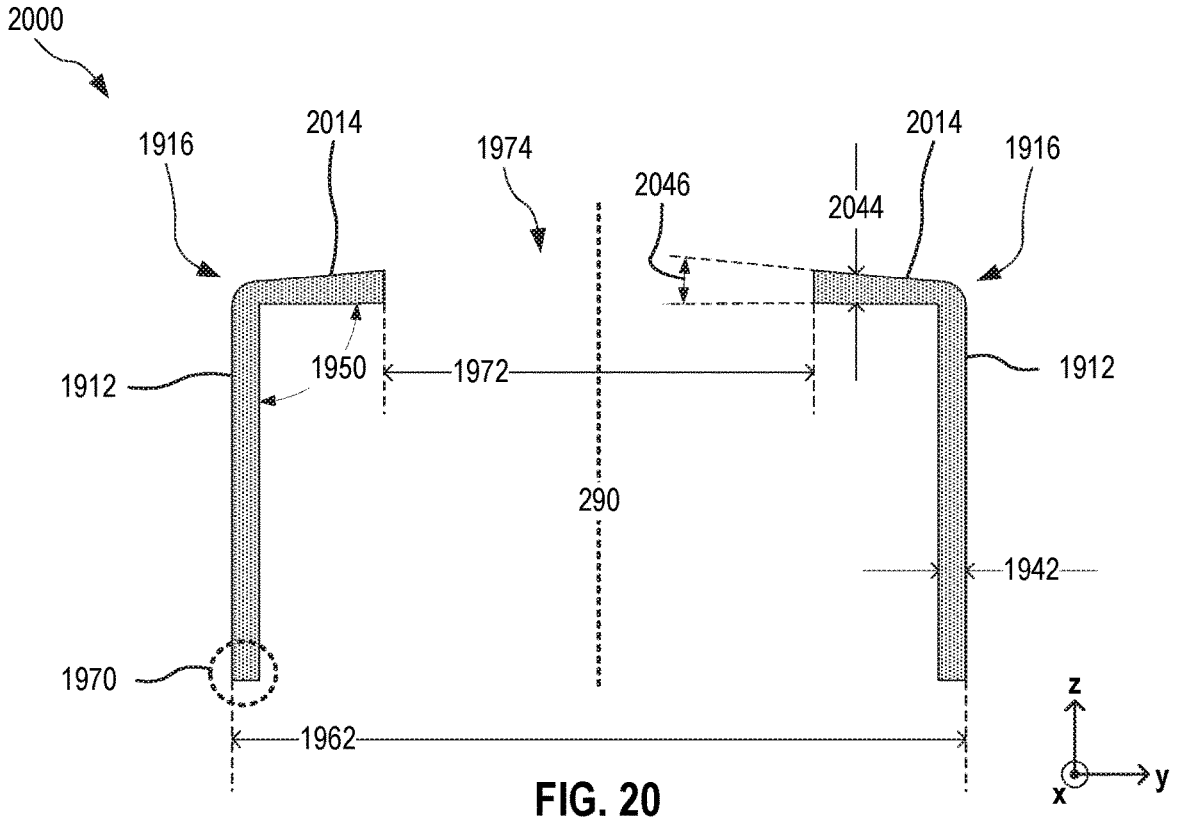
FIG. 20 illustrates a ring-shaped workpiece having a lip of non-uniform thickness, according to an embodiment.

FIG. 20 illustrates one ring-shaped workpiece 2000 having a lip of non-uniform thickness. Workpiece 2000 is an embodiment of workpiece 1900 that implements lip 1914 as a lip 2014 with gradually increasing thickness in the direction toward cylinder axis 290. Lip 2014 is similar to lip 1914 apart from specifically having a gradually increasing thickness. Lip 2014 has thickness 2044. Thickness 2044 increases gradually from edge 1916 to aperture 1974. In an embodiment, thickness 2044 increases in a substantially linear manner, such the top and bottom surfaces of lip 2014 are at a non-zero angle 2046 relative to each other. This results in a keystone effect. In one embodiment, method 500 is performed to achieve a desired keystone effect. In another embodiment, method 500 is optimized to minimize the keystone effect. In such embodiments, the keystone effect of lip 2014 may be less than 10%. Referring again to FIG. 19, lip 1914 of workpiece 1900 may have no keystone effect.

Figure 21:
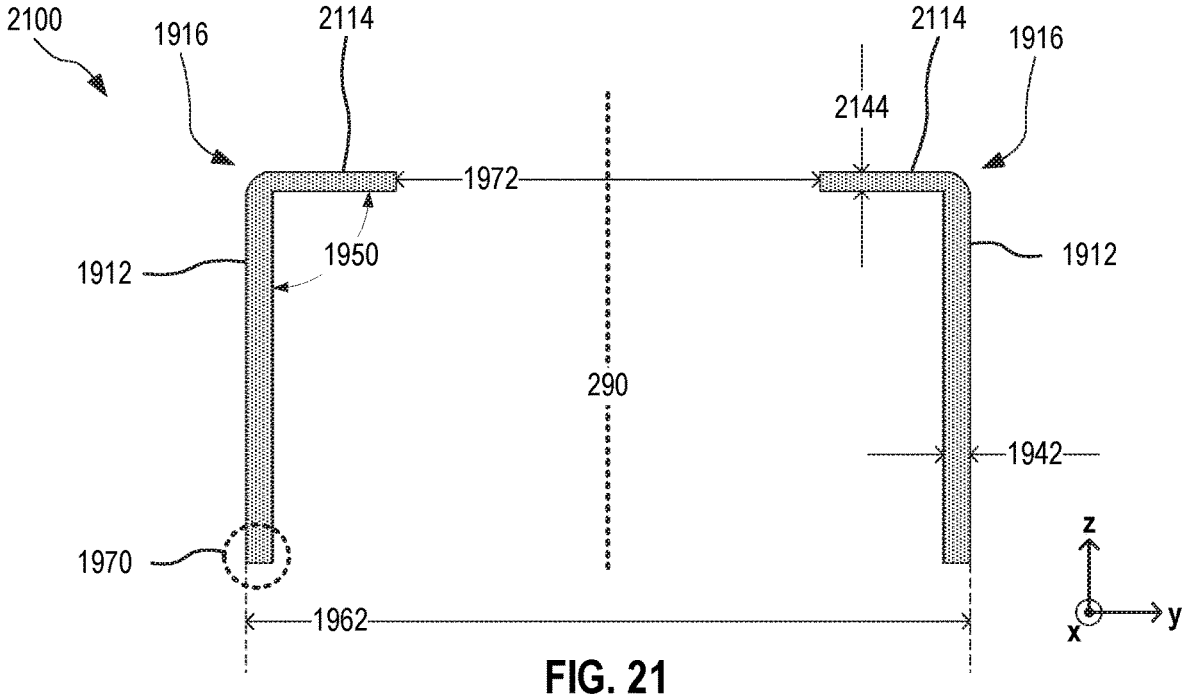
FIG. 21 illustrates a ring-shaped workpiece having a sidewall and a lip that is thinner than the sidewall, according to an embodiment.

FIG. 21 illustrates one ring-shaped workpiece 2100 having a sidewall and a lip that is thinner than the sidewall. Workpiece 2100 is an embodiment of workpiece 1900 that implements lip 1914 as a lip 2114. Lip 2114 is similar to lip 1914 apart from specifically being thinner than sidewall 1912. Lip 2114 has thickness 2144 which is less than thickness 1944 of sidewall 1912. Lip 2114 is formed, for example, by an embodiment of method 500 that includes step 536.

Figure 22:
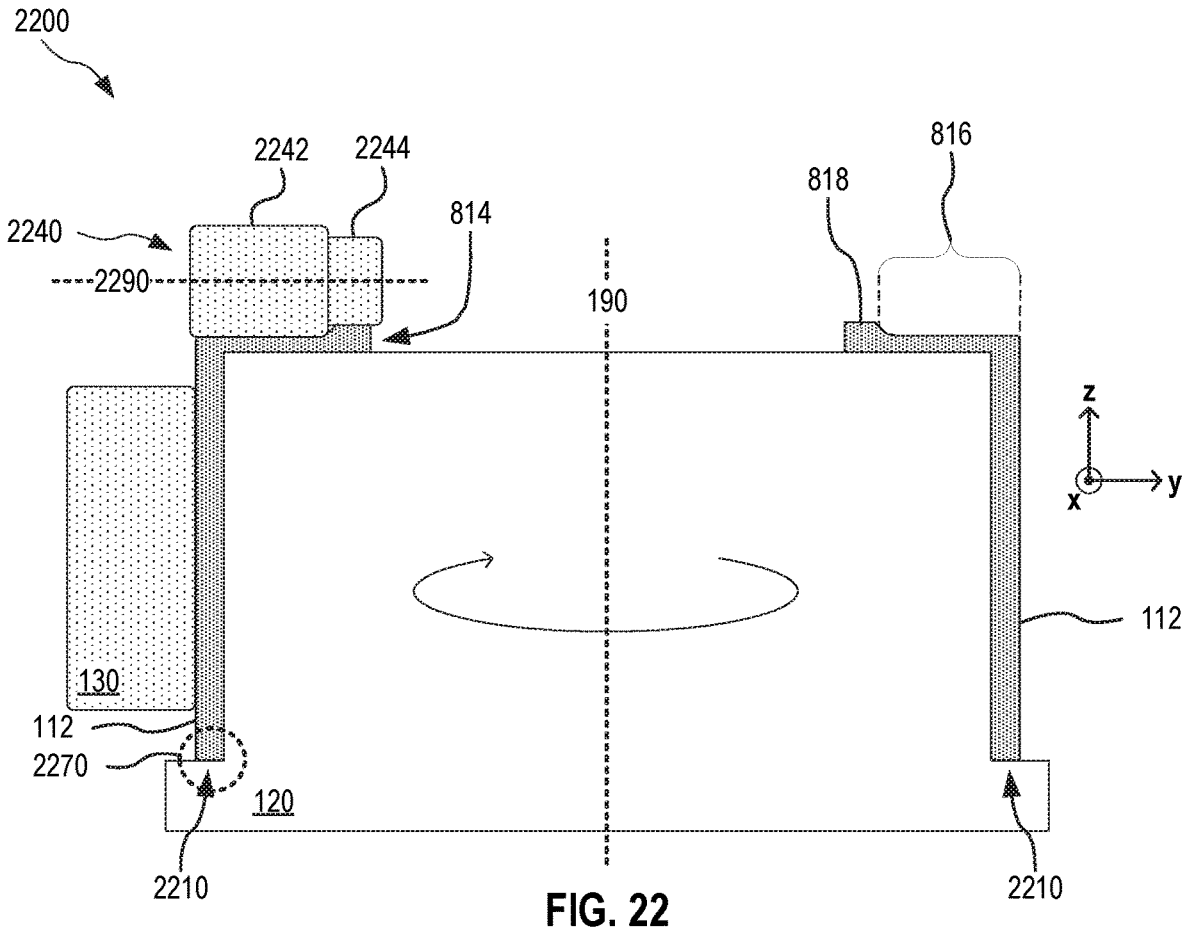
FIG. 22 illustrates a multi-axis form-rolling system having a dual-diameter form roller, according to an embodiment.

FIG. 22 illustrates one multi-axis form-rolling system 2200 having a dual-diameter form roller. System 2200 is an embodiment of system 100 that implements form roller 140 as a dual-diameter form roller 2240. Dual-diameter form roller 2240 includes two roller portions 2242 and 2244, each of which is configured to rotate about a common rotation axis 2290. The diameter of roller portion 2242 is greater than the diameter of roller portion 2244. Roller portions 2242 and 2244 may be rigidly coupled to each other, or even integrally formed from one part. Alternatively, roller portions 2242 and 2244 may be free to rotate about rotation axis 2290 at different rates.

When system 2200 performs steps 510, 520, and 530 on workpiece 110, dual-diameter form roller 2240 forms a ring-shaped workpiece 2210 with a lip 814 that has a larger-diameter section 816 and a ridge 818 (see FIG. 8). System 2200 thus provides an alternative to method 800 that does not require a second application of the form roller.

Without departing from the scope hereof, workpiece 2210 may extend beyond the lower end 2270 of sidewall 112, as discussed above in reference to FIGS. 1 and 4.

Figure 23:
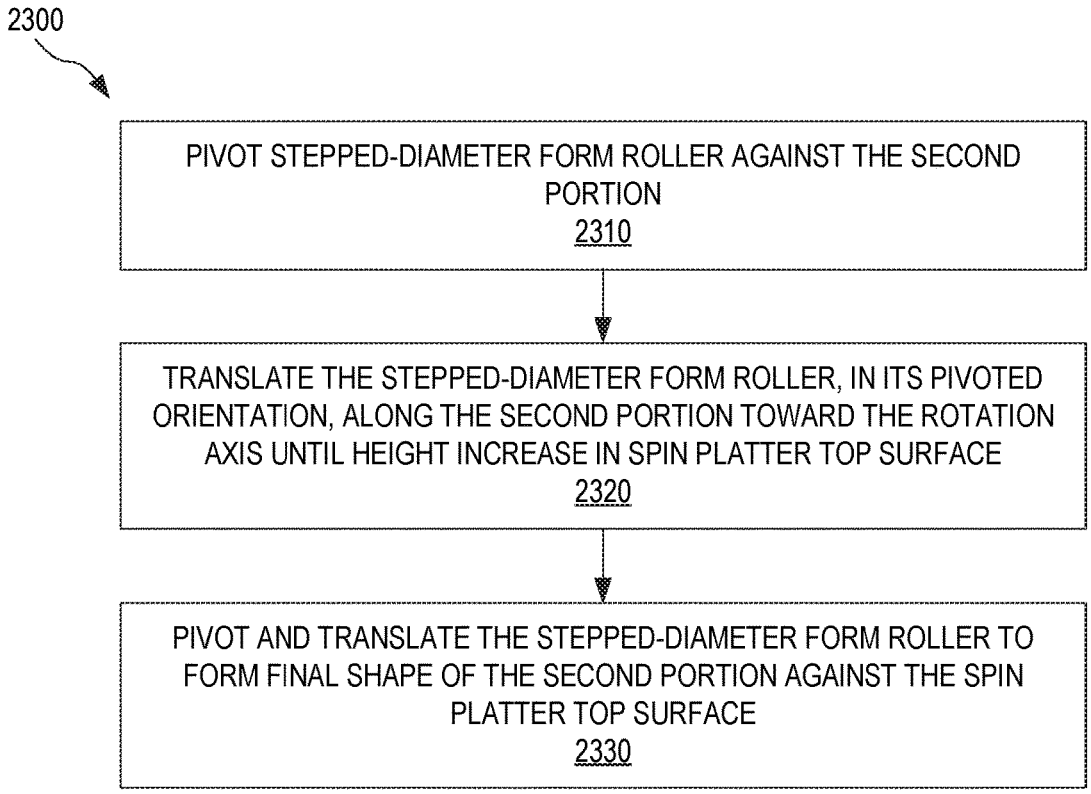
FIGS. 23 and 24A-D illustrate a multi-axis roll-forming method for forming a stepped-height lip, according to an embodiment.

FIGS. 23 and 24A-D illustrate a multi-axis roll-forming method 2300 for forming a stepped-height lip. FIG. 23 is a flowchart for method 2300. FIGS. 24A-D show an example of method 2300 that utilizes a stepped-diameter form roller 2440 and a spin platter 2420, having a profiled top surface, to form a ring-shaped workpiece 2410 with a stepped-height lip 2494. FIGS. 23 and 24A-D are best viewed together in the following description.

Method 2300 is an embodiment of step 530 and may be performed by an embodiment of system 100 that implements spin platter 2420 and form roller 2440. Method 2300 is performed simultaneously with steps 510 and 520.

Stepped-diameter form roller 2440 is an embodiment of form roller 140 that includes two portions 2442 and 2444. When form-roller 2440 is pivoted toward rotation axis 190, portion 2442 is further from rotation axis 190 and portion 2444 is closer to rotation axis 190. Portion 2442 has diameter 2452, and portion 2444 has diameter 2454. Diameter 2452 is greater than diameter 2454. Spin platter 2420 is an embodiment of spin platter 120 having a profiled top surface 122. Spin platter 2420 includes (a) a top surface 2422 adjacent the radially-outward-facing surface 124 of spin platter 2420, and (b) a top surface 2424 radially inwards from top surface 2422. Top surfaces 2422 and 2424 have a height difference 2428, with top surface 2422 being of lesser height than top surface 2424. Form roller 2440 may exhibit a gradual or step-wise diameter decrease from portion 2442 to portion 2444. Likewise, height increase 2428 of the top surface of spin platter 2420 may be gradually or step-wise. In certain implementations, the profile of portions 2442 and 2444 and the diameter increase therebetween is specifically matched to the profile of top surfaces 2422 and 2424 and height difference 2428. Form roller 2440 and spin platter 2420 are embodiments of form roller 2240 and spin platter 120, respectively.

Figure 24A:
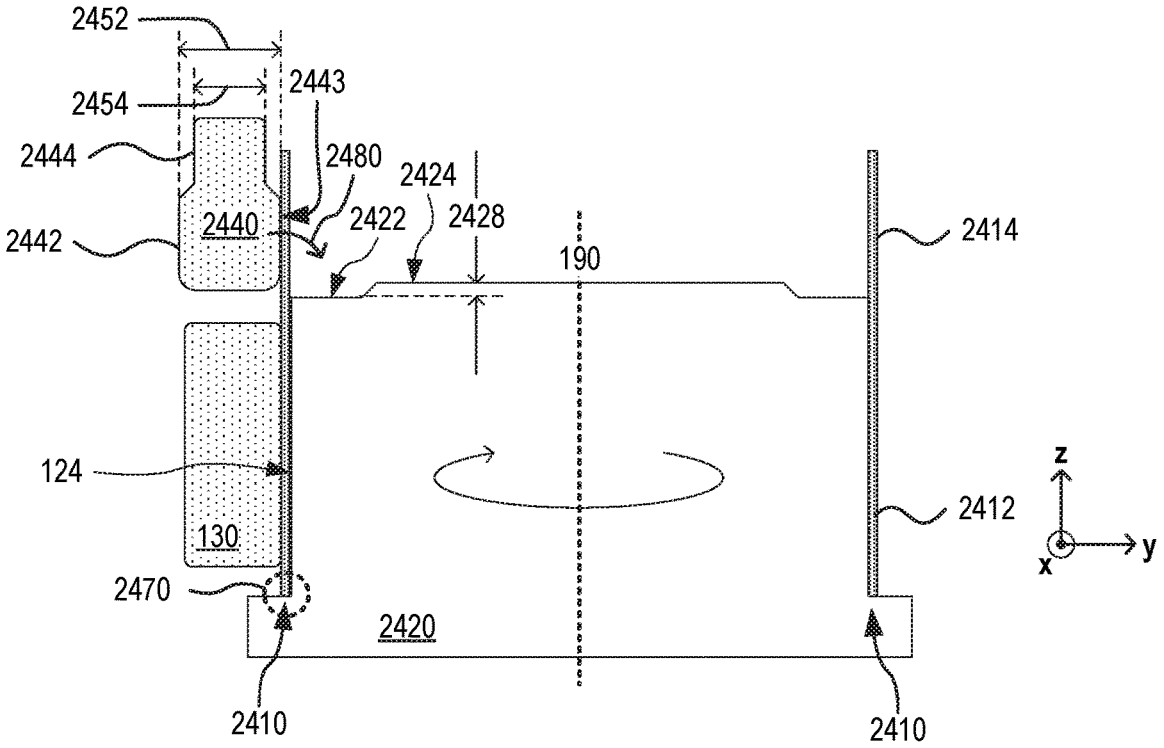
Figure 24B:
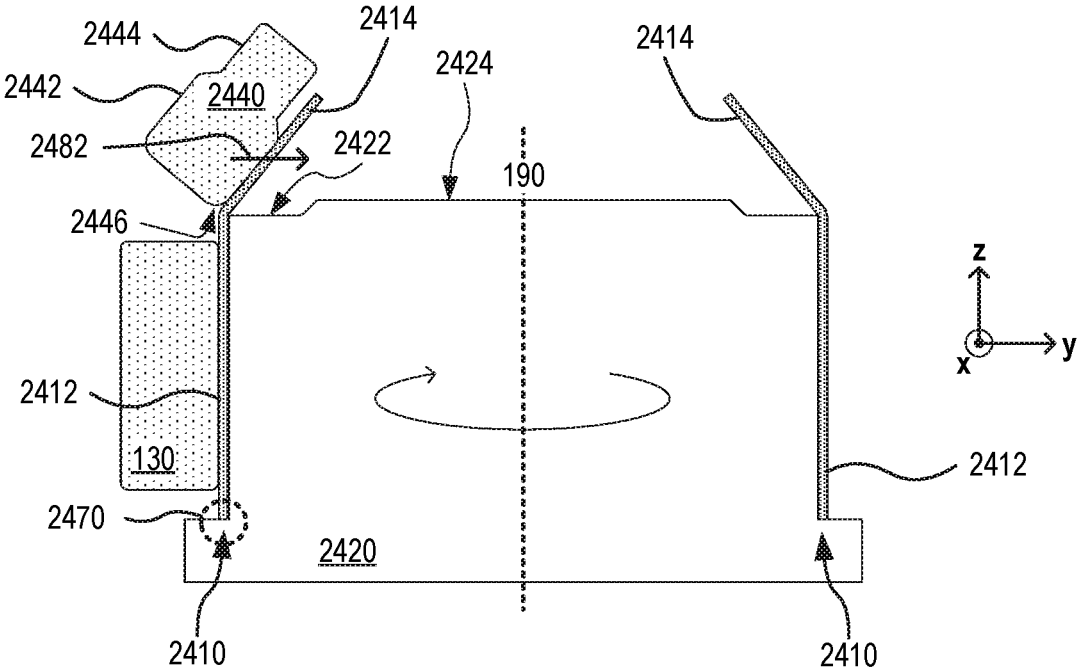

In a step 2310, method 2300 pivots a stepped-diameter form roller against the radially-outward-facing surface of a second portion of the workpiece to bend this second portion radially inward toward the rotation axis. FIGS. 24A and 24B show an example of step 2310. In this example, a ring-shaped workpiece 2410 spins with spin platter 2420, while one or more support rollers 130 press a lower portion 2412 of workpiece 2410 against radially-outward-facing surface 124 of spin platter 2420. As shown in FIG. 24A, form roller 2440 starts from an initial position characterized by a radially-outward-facing surface 2443 of portion 2442 of form roller 2440 being parallel with an upper portion 2414 of workpiece 2410. At this stage, upper portion 2414 and lower portion 2412 are two different sections of a continuous sidewall. Form roller 2440 then pivots inward (as indicated by arrow 2480) to bend upper portion 2414 toward rotation axis 190 and partway toward top surfaces 2422 and 2424, as shown in FIG. 24B.

Figure 24C:
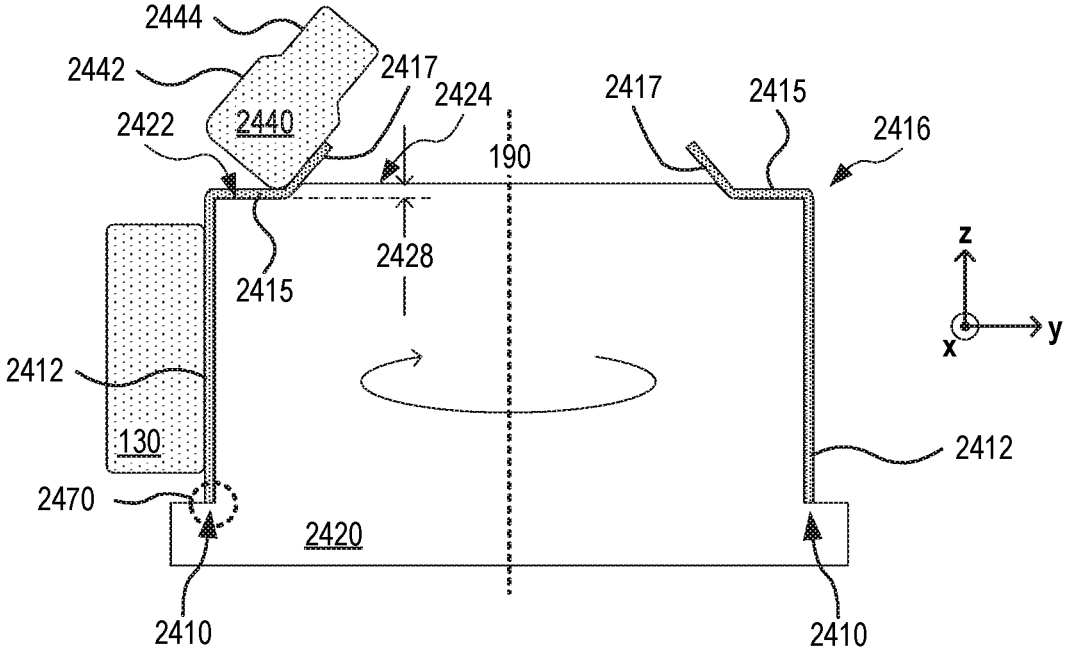

In a step 2320, method 2300 translates the stepped-diameter form roller, in its pivoted orientation, along the second portion of the workpiece toward the rotation axis until reaching the height increase in spin platter top surface. FIGS. 24B and 24C show an example of step 2320. In this example, form roller 2440 translates toward rotation axis 190, as indicated by arrow 2482 in FIG. 24B, while form roller 2440 is in the pivoted orientation achieved in the related example of step 2310. During this translation, a corner 2446 of form roller 2440 presses a section 2415 of upper portion 2414 against the lesser-height top surface 2422 of spin platter 2420, as shown in FIG. 24C. This translation of form roller 2440 stops when form roller 2440 reaches height increase 2428 between top surface 2422 and 2424. At this stage, section 2415 of upper portion 2414 has been shaped to substantially match lesser-height top surface 2422, while a remaining section 2417 of upper portion 2414, closer to rotation axis 190, is oriented at an angle to top surface 2422. The orientation of portion 2417 is dictated by multiple factors, such as the orientation of form roller 2440, the shape of height increase 2428, and the material properties of upper portion 2414. The orientation of portion 2417 after completion of step 2320 may deviate from that shown in FIG. 24C.

In an embodiment, the translation performed in step 2320 helps ensure that corner 2416 between lower portion 2412 and upper portion 2414 does not bulge radially outward relative to lower portion 2412, or axially upward relative to section 2415. Step 2320 may include extruding the material of upper portion 2414 toward rotation axis 190.

Figure 24D:
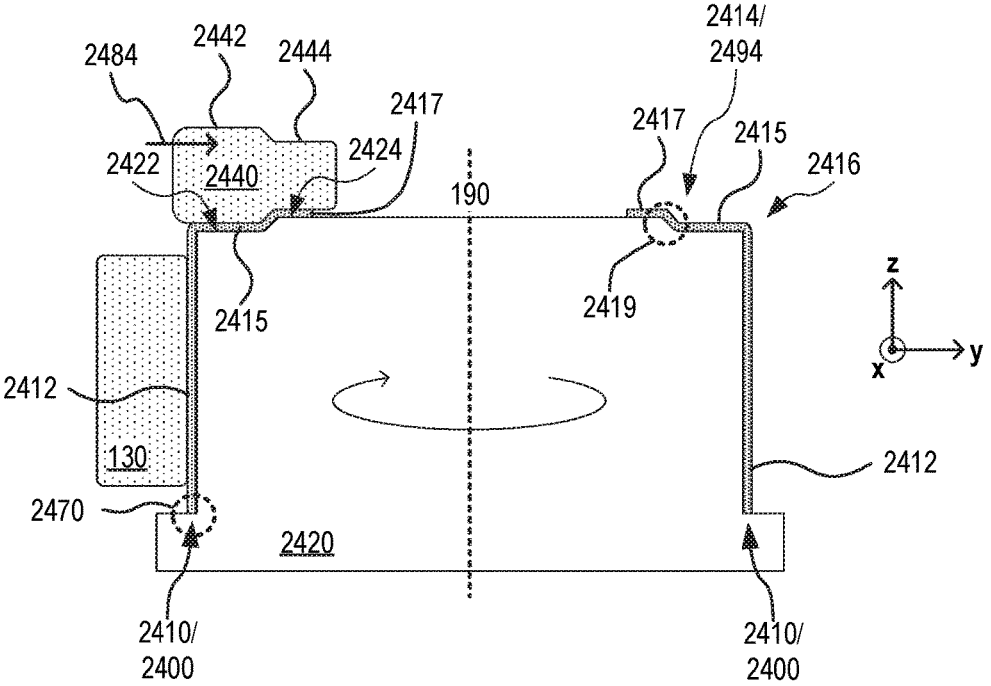

In a step 2330, method 2300 pivots and translates the stepped-diameter form roller to form a final shape of the second portion against the spin platter top surface. Step 2330 repositions the form roller radially outward, pivots the form roller such that its orientation matches the profile of the stepped-height top surface of the spin platter, and translates the form roller along the second portion to shape a section of the second portion against the greater-height top surface of the spin platter. Step 2330 may also refine the shape of the section of the second portion already pressed against the lesser-height top surface of the spin platter in step 2320, and/or refine the shape of the second portion to more closely match the shape of the height increase between the lesser-height and greater-height top surfaces of the spin platter. FIG. 24D show an example of step 2330 that modifies workpiece 2410, as depicted in FIG. 24C, to form a workpiece 2400. In this example, form roller 2440 has been pivoted such that the radially-outward-facing surfaces of portions 2442 and 2444 are parallel to top surfaces 2422 and 2424. Form roller 2440 has then been translated (as indicated by arrow 2484) in the direction toward rotation axis 190 until (as shown in FIG. 24D) upper portion 2414 is sandwiched between form roller 2440 and top surfaces 2422 and 2424 of spin platter 2420. As a result, upper portion 2414 now forms a stepped-height lip 2494 with (a) section 2415 matching top surface 2422, (b) portion 2417 matching top surface 2424, and (c) a step-up section 2419 that substantially matches the profile of height increase 2428.

Step 2320 may include extruding the material of upper portion 2414 toward rotation axis 190.

Without departing from the scope hereof, the profile of the second portion may deviate somewhat from the profile of the stepped-height top surface of the spin platter, after completion of method 2300. In particular, when the height-increase of the spin platter is abrupt, the second portion may exhibit a more gradual height increase than the spin platter top surface at this location.

Also without departing from the scope hereof, workpiece 2410/2400 may extend beyond the lower end 2470 of lower portion 2412, as discussed above in reference to FIGS. 1 and 4.

Figure 25:
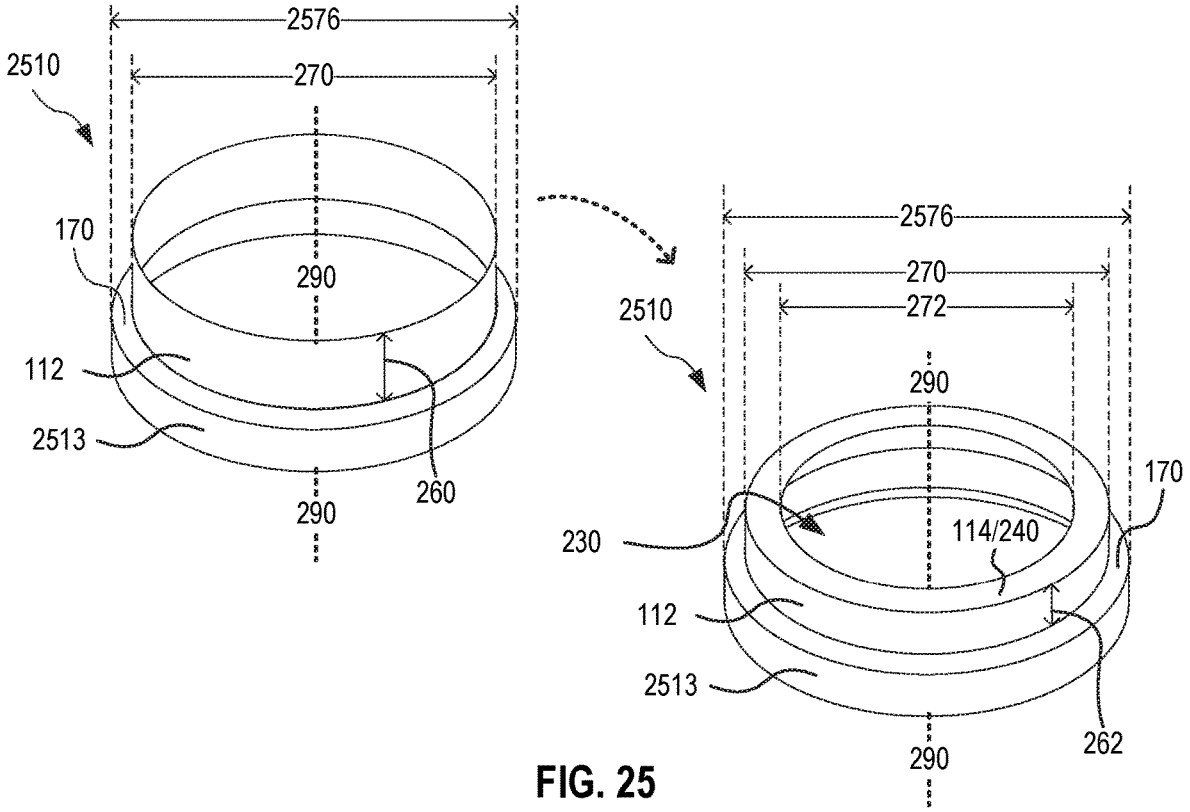
FIG. 25 illustrates multi-axis roll-forming of a stepped-diameter cylinder to form a lip at a smaller-diameter-end of the stepped-diameter cylinder, according to an embodiment.

FIG. 25 illustrates multi-axis roll-forming of a stepped-diameter cylinder 2510 to form lip 240 at a smaller-diameter-end of stepped-diameter cylinder 2510. Stepped-diameter cylinder 2510 is an example of workpiece 110 that includes flange 170 and a larger-diameter cylinder 2513 in connection with flange 170. Flange 170 and larger-diameter cylinder 2513 have outer diameter 2576. Outer diameter 2576 is greater than diameter 270.

The process depicted in FIG. 25 is an embodiment of the process shown in FIG. 2, specifically pertaining to a stepped-diameter cylinder. Multi-axis roll-forming of workpiece 2510, as shown in FIG. 25, may be performed according to method 500 as discussed above for workpiece 110, for example. The systems, methods, and workpieces discussed above in reference to FIGS. 1-24D are readily extended to stepped-diameter cylinder 2510.

Figure 26:
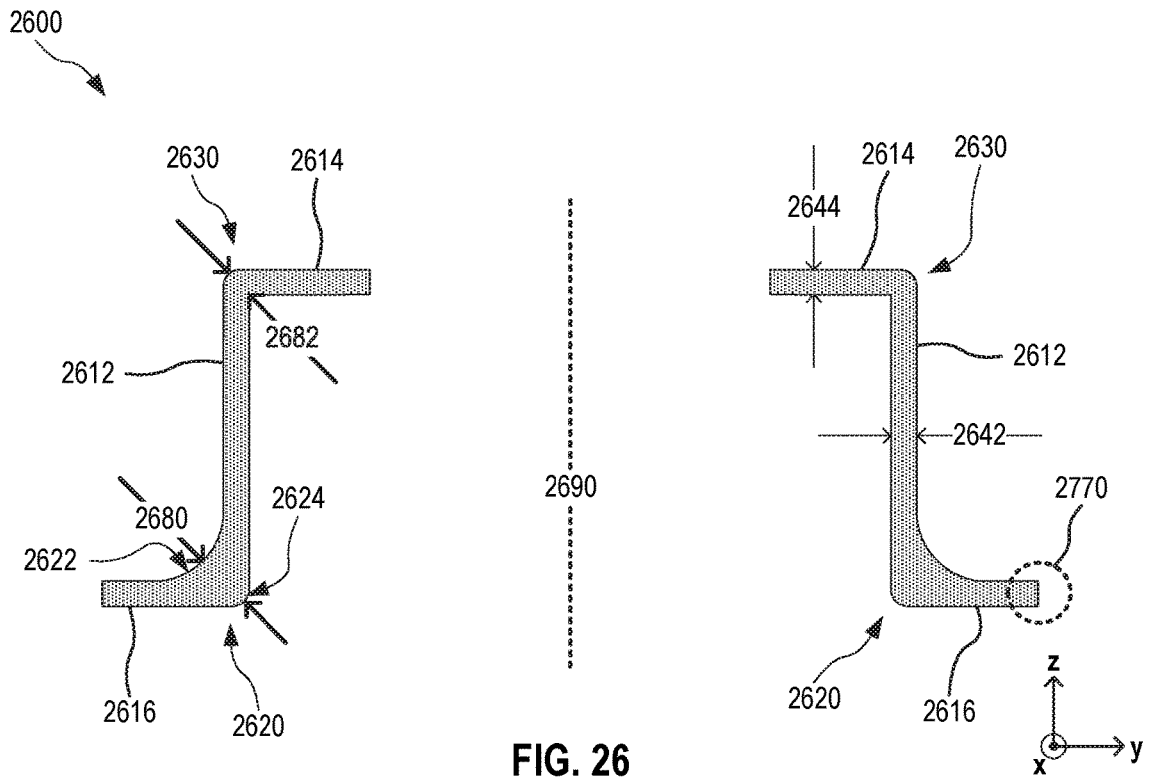
FIG. 26 illustrates a profiled ring having two edges with different respective thicknesses, according to an embodiment.

FIG. 26 illustrates one profiled ring 2600 having two edges with different respective thicknesses. Profiled ring 2600 encircles a cylinder axis 2690 and is symmetric with respect to rotation about cylinder axis 2690. Profiled ring 2600 includes a sidewall 2612 extending along a section of cylinder axis 2690, a lip 2614 extending from a top end of sidewall 2612 toward cylinder axis 2690, and a flange 2616 extending from a bottom end of sidewall 2612 away from cylinder axis 2690. At least a portion of sidewall 2612 is parallel to cylinder axis 2690. Sidewall 2612, lip 2614, and flange 2616 are different parts of a single continuous piece, optionally including a weld seam spanning the height of profiled ring 2600 along cylinder axis 2690. The edge 2630 connecting sidewall 2612 and lip 2614 has thickness 2682, whereas the edge 2620 connecting sidewall 2612 and flange 2616 has thickness 2680 which is greater than thickness 2682 and also greater than thickness 2642 of sidewall 2612. The greater thickness 2680 of edge 2620 may increase the strength of edge 2620 to reduce the ability or risk of deflection of flange 2616 relative to sidewall 2612.

In one embodiment, the inside surface 2622 and outside surface 2624 of edge 2620 have similar radii of curvature. In another embodiment, the radius of curvature of the inside surface 2622 of edge 2620 is greater than the radius of curvature of the outside surface 2624 of edge 2620, as depicted in FIG. 26. In certain embodiments, thickness 2680 of edge 2620 exceeds thickness 2642 of sidewall 2612. Thickness 2644 of lip 2614 and thickness 2682 of edge 2630 may be similar to, less than, or greater than thickness 2642.

Without departing from the scope hereof, profiled ring 2600 may extend beyond the outer end 2770 of flange 2616 and for example for a stepped-diameter cylinder. Also without departing from the scope hereof, lip 2614 may be at an oblique angle to cylinder axis 2690.

Figure 27:
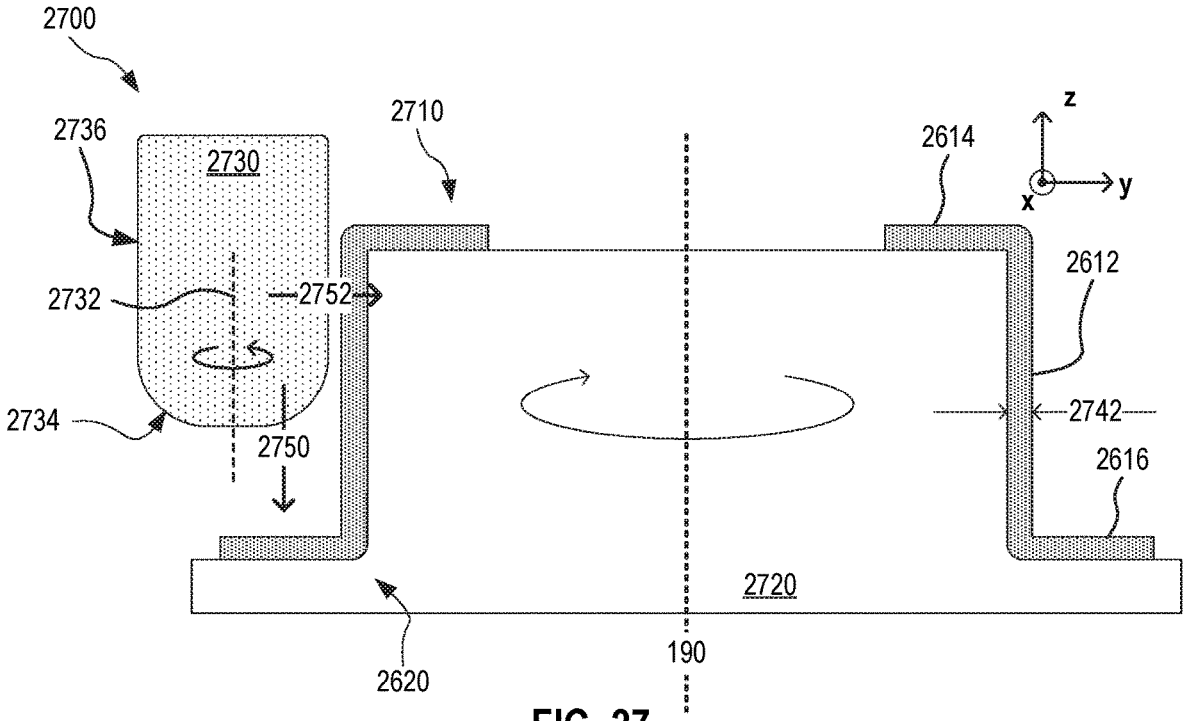
FIG. 27 illustrates a multi-axis roll-forming method for thickening an edge of a ring-shaped workpiece, according to an embodiment.

FIG. 27 illustrates a multi-axis roll-forming method 2700 for thickening an edge of a ring-shaped workpiece 2710 to form profiled ring 2600. Ring-shaped workpiece 2710 may be an embodiment of workpiece 110 formed by method 500. Workpiece 2710 includes sidewall 2612, lip 2614, and flange 2616. However, prior to performing method 2700, the edge between sidewall 2612 and flange 2616 has similar thickness to the edge between sidewall 2612 and lip 2614.

Method 2700 spins workpiece 2710 on a spin platter 2720 that spins about rotation axis 190. While workpiece 2710 spins, method 2700 presses a roller 2730 against sidewall 2612 (as indicated by arrow 2752) and downwards toward flange 2616 (as indicated by arrow 2750). The downwards translation of roller 2730 along the direction or arrow 2750, combined with the radially inwards pressure in the direction along arrow 2752, extrudes material of sidewall 2612 to be built up at edge 2620, and method 2700 thereby produces profiled ring 2600. The extrusion of material from sidewall 2612 into edge 2620 may result in some thinning of sidewall 2612 from an initial thickness 2742 to thickness 2642. Roller 2730 has a surface 2736 that presses against sidewall 2612, and a rounded corner 2734 resembling the desired shape of inside surface 2622 of profiled ring 2600. When roller 2730 is in contact with spinning workpiece 2710, roller 2730 rotates about a rotation axis 2732.

Method 2700 may be implemented in method 500 as at least a part of step 550. Furthermore, method 2700 may be performed by an embodiment of system 100 that implements roller 2730 either (a) in addition to support roller(s) 130 and form roller 140 or (b) as each of one or more support rollers 130.

Figure 28:
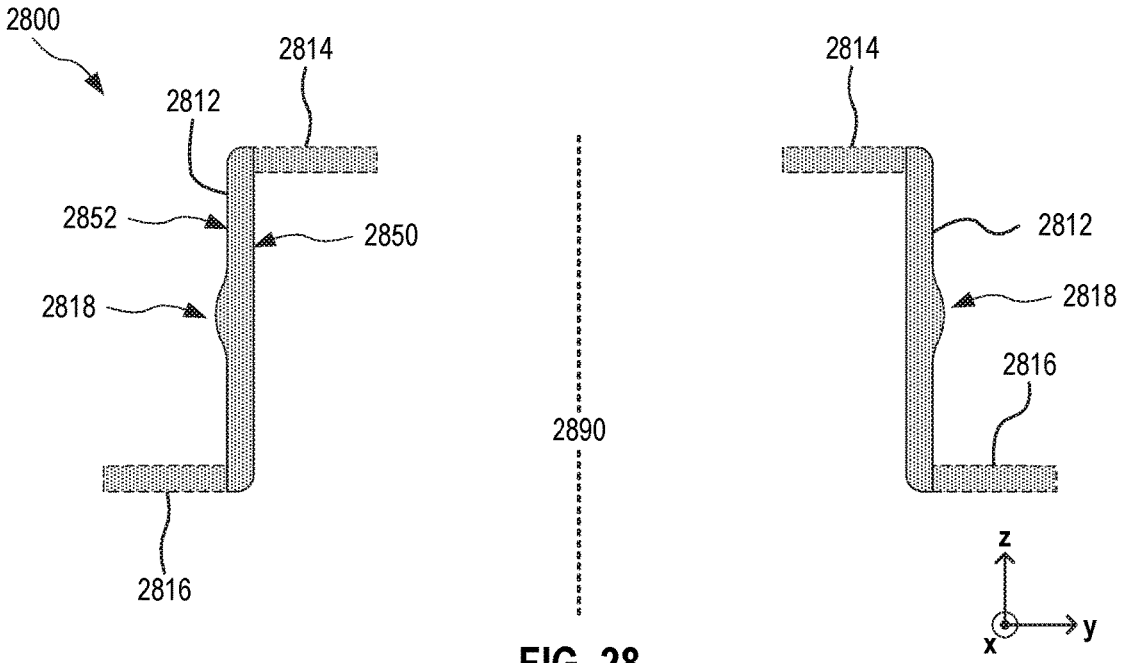
FIG. 28 illustrates a ring having a sidewall with a thicker ridge, according to an embodiment.

FIG. 28 illustrates one ring 2800 having a sidewall with a thicker ridge. Ring 2800 encircles a cylinder axis 2890 and is symmetric with respect to rotation about cylinder axis 2890. Ring 2800 includes a sidewall 2812 extending along a section of cylinder axis 2890. Ring 2800 may further include a lip 2814 extending from a top end of sidewall 2812 toward cylinder axis 2890, and/or a flange 2816 extending from a bottom end of sidewall 2812 away from cylinder axis 2890. At least a portion of the radially-inward-facing surface 2850 of sidewall 2812 is parallel to cylinder axis 2890. The radially-outward-facing surface 2852 of sidewall 2812 forms a ridge 2818 that protrudes in the direction away from cylinder axis 2890. Ridge 2818 encircles cylinder axis 2890.

Figure 29:
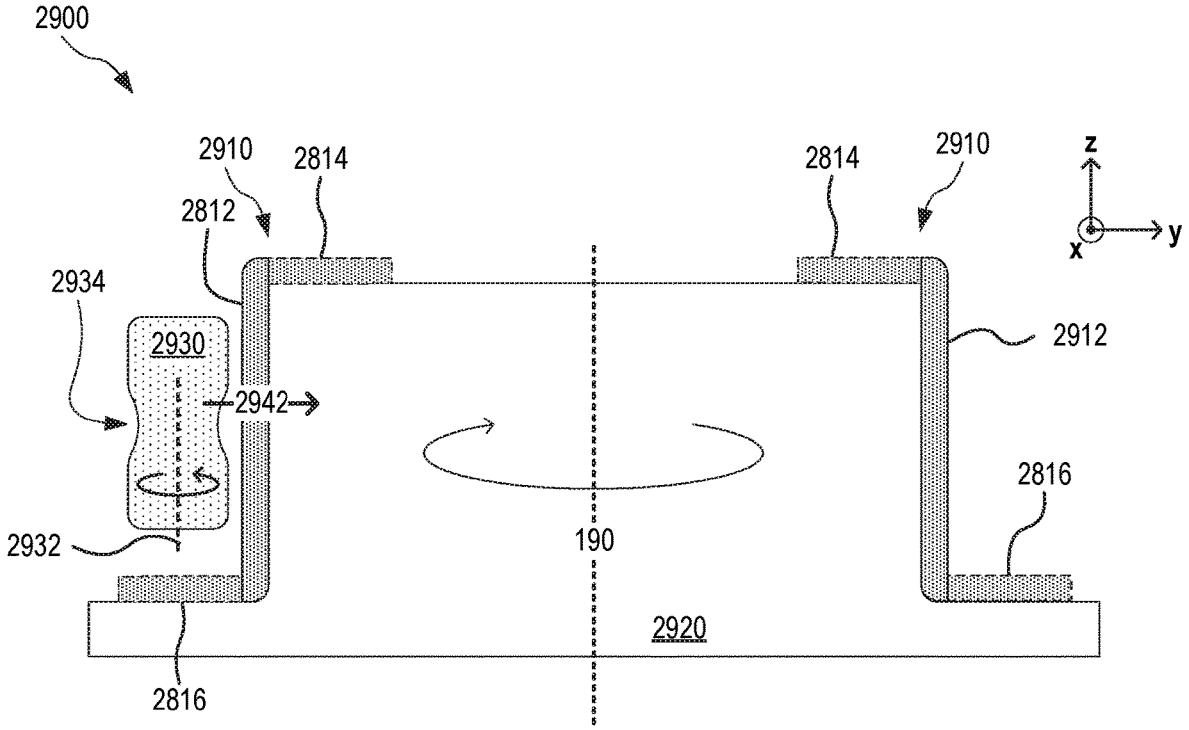
FIG. 29 illustrates a roll-forming method for making a ridge in the sidewall of a ring-shaped workpiece, according to an embodiment.

FIG. 29 illustrates one roll-forming method 2900 for making a ridge in the sidewall of a ring-shaped workpiece 2910 to produce ring 2800. Workpiece 2910 includes a cylindrical sidewall 2912. Workpiece 2910 may further include lip 2814 and/or flange 2816 respectively connected with the upper and lower ends of sidewall 2912. Workpiece 2910 may be an embodiment of workpiece 110 formed by method 500, or an embodiment of workpiece 110 prior to multi-axis roll-forming according to steps 510, 520, and 530. In the latter case, method 2900 may be implemented as an embodiment of steps 510 and 520 of method 500. Alternatively, workpiece 2910 is not an embodiment of workpiece 110.

Method 2900 spins workpiece 2910 on a spin platter 2920 that spins about rotation axis 190. While workpiece 2910 spins, method 2900 presses a roller 2930 against sidewall 2812, as indicated by arrow 2942. When roller 2930 is in contact with spinning workpiece 2910, roller 2930 rotates about a rotation axis 2932. Roller 2930 has a thinner section 2934 that encircles rotation axis 2932. Pressure from roller 2930 onto sidewall 2912 forces material of sidewall 2912 to build up in the gap between thinner section 2934 and sidewall 2912 to produce ridge 2818. Method 2900 thereby forms ring 2800.

Method 2900 may be implemented in method 500 as at least a part of steps 510 and 520. Furthermore, method 2900 may be performed by an embodiment of system 100 that implements roller 2930 either (a) in addition to support roller(s) 130 and form roller 140 or (b) as each of one or more support rollers 130.

Figure 30:
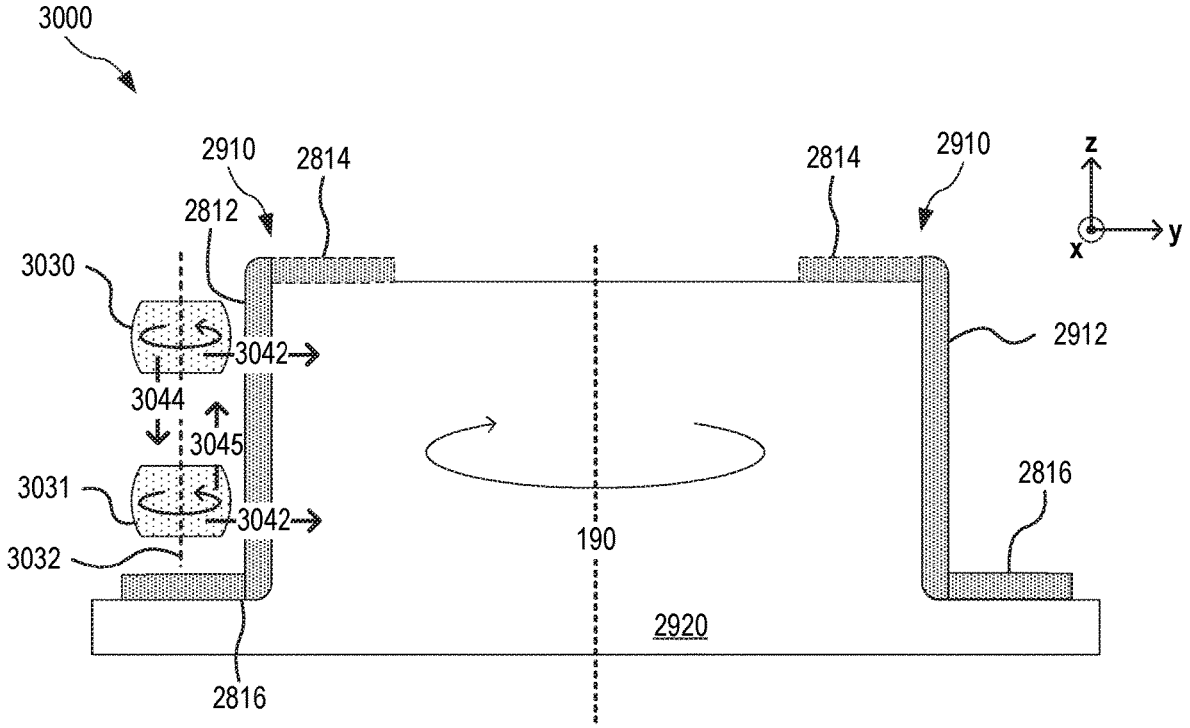
FIG. 30 illustrates a multi-axis roll-forming method for making a ridge in sidewall of ring-shaped workpiece, according to an embodiment.

FIG. 30 illustrates one multi-axis roll-forming method 3000 for making ridge 2818 in sidewall 2912 of ring-shaped workpiece 2910 to produce ring 2800. Method 3000 is similar to method 2900 except for replacing roller 2930 with a pair of rounded rollers 3030 and 3031. Rollers 3030 and 3031 are configured to simultaneously (a) press against sidewall 2912, as indicated by arrows 3042, and spin about a common rotation axis 3032, and (b) translate toward each other as indicated by arrows 3044 and 3045. This action by rollers 3030 and 3031 locally builds up material of sidewall 2812 to form ridge 2818. Method 3000 thereby forms ring 2800.

Figure 31:
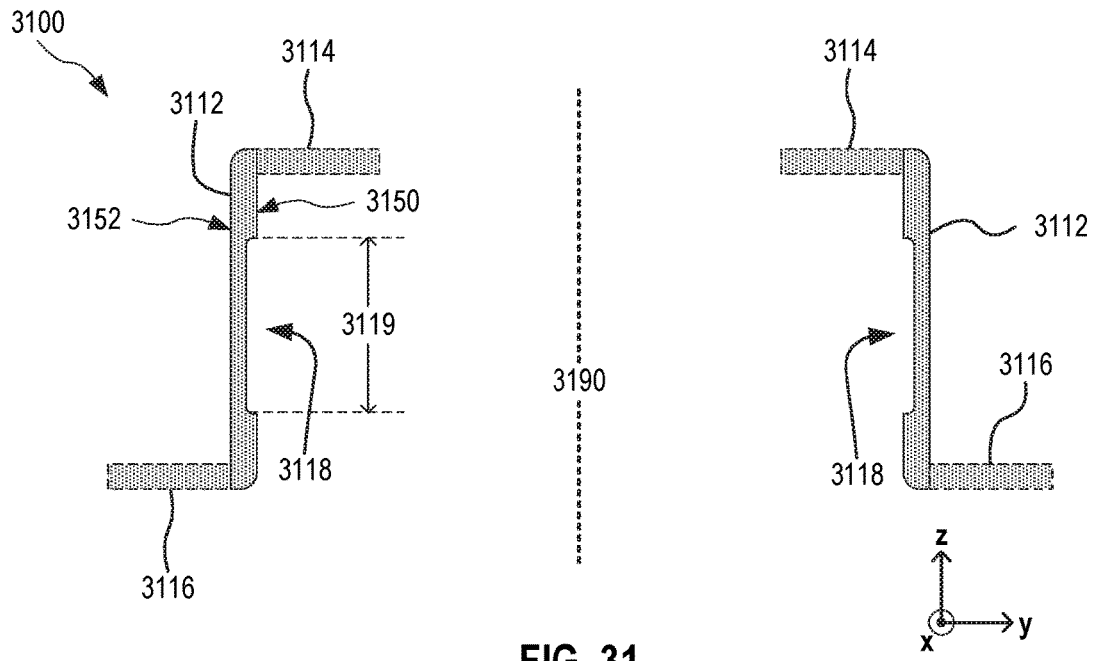
FIG. 31 illustrates a ring having a locally thinned sidewall, according to an embodiment.

FIG. 31 illustrates one ring 3100 having a locally thinned sidewall. Ring 3100 encircles a cylinder axis 3190 and is symmetric with respect to rotation about cylinder axis 3190. Ring 3100 includes a sidewall 3112 extending along a section of cylinder axis 3190. Ring 3100 may further include a lip 3114 extending from a top end of sidewall 3112 toward cylinder axis 3190, and/or a flange 3116 extending from a bottom end of sidewall 3112 away from cylinder axis 3190.

A portion of the radially-inward-facing surface 3150 of sidewall 3112 forms a recess 3118. Recess 3118 has height 3119 along cylinder axis 3190. Height 3119 is less than the total extent of sidewall 3112 along cylinder axis 3190. The radially-outward-facing surface 3152 of sidewall 3112 is parallel to cylinder axis 3190. Consequently, sidewall 3112 is thinner in the section associated with recess 3118 than elsewhere. Recess 3118 encircles cylinder axis 3190.

Figure 32:
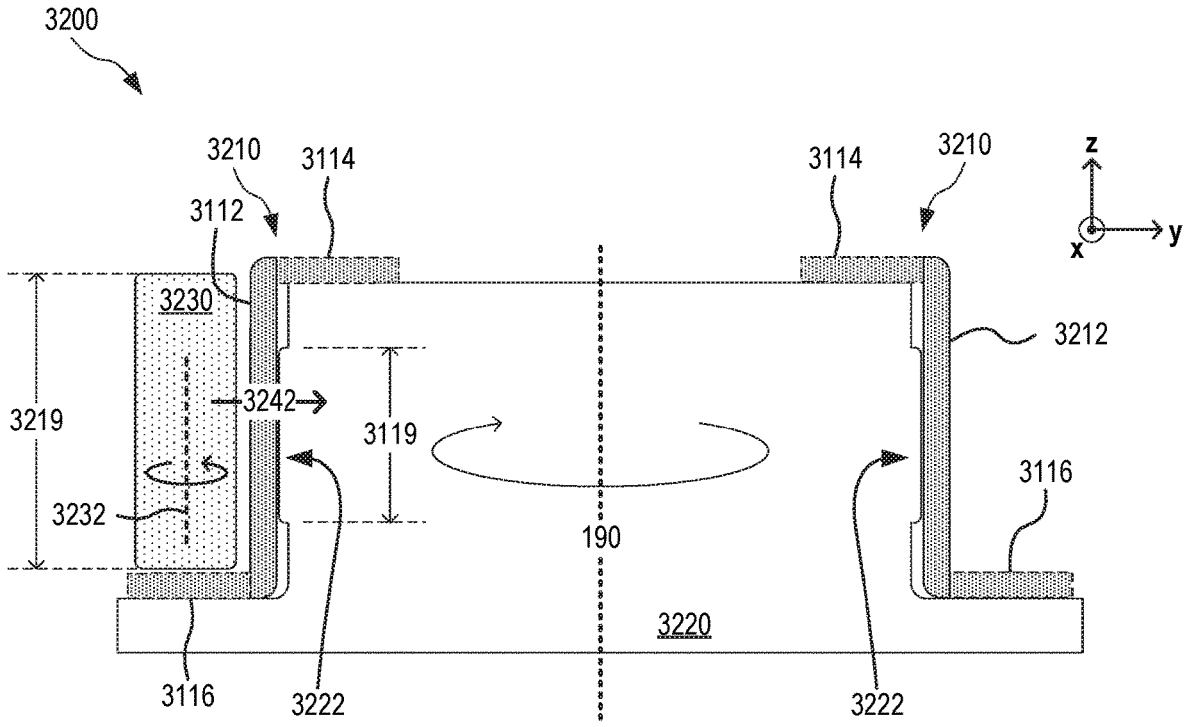
FIG. 32 illustrates a roll-forming method for locally thinning a sidewall of a ring-shaped workpiece, according to an embodiment.

FIG. 32 illustrates one roll-forming method 3200 for locally thinning a sidewall of a ring-shaped workpiece 3210 to form ring 3100. Workpiece 3210 includes a cylindrical sidewall 3212 (similar to sidewall 2912). Workpiece 3210 may further include lip 3114 (similar to lip 2814) and/or flange 3116 (similar to flange 2816) respectively connected with the upper and lower ends of sidewall 3212. Workpiece 3210 may be an embodiment of workpiece 110 formed by method 500, or an embodiment of workpiece 110 prior to multi-axis roll-forming according to steps 510, 520, and 530. In the latter case, method 3200 may be implemented as an embodiment of steps 510 and 520 of method 500. Alternatively, workpiece 3210 is not an embodiment of workpiece 110.

Method 3200 spins workpiece 3210 on a spin platter 3220 that spins about rotation axis 190. Spin platter 3220 has a radial protrusion 3222 that encircles rotation axis 190. Radial protrusion 3222 has height 3119. While workpiece 3210 spins, method 3200 presses a roller 3230 against sidewall 3212, as indicated by arrow 3242. When roller 3230 is in contact with spinning workpiece 3210, roller 3230 rotates about a rotation axis 3232. The height 3219 of roller 3230 exceeds height 3119. Pressure from roller 3230 onto sidewall 3212 forces material of sidewall 3212 away from protrusion 3222, resulting in local thinning of sidewall 3212, to produce recess 3118. Method 3200 thereby forms ring 3100.

Method 3200 may be implemented in method 500 as at least a part of steps 510 and 520. Furthermore, method 3200 may be performed by an embodiment of system 100 that (a) implements spin platter 3220 as spin platter 120 and (b) implements roller 3230 as each of one or more support rollers 130.

Figure 33:
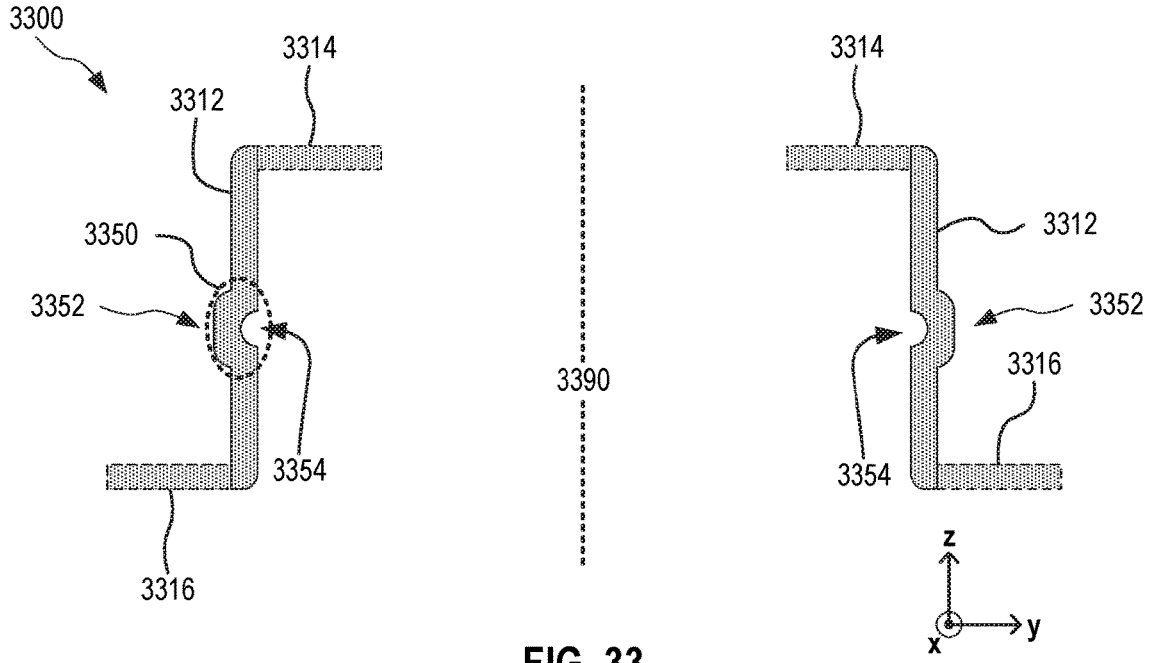
FIG. 33 illustrates a ring having a sidewall with a rib, according to an embodiment.

FIG. 33 illustrates one ring 3300 having a sidewall 3312 with a rib 3350. Ring 3300 encircles a cylinder axis 3390 and is symmetric with respect to rotation about cylinder axis 3390. Ring 3300 includes a sidewall 3312 extending along a section of cylinder axis 3390. Ring 3300 may further include a lip 3314 extending from a top end of sidewall 3312 toward cylinder axis 3390, and/or a flange 3316 extending from a bottom end of sidewall 3312 away from cylinder axis 3390. Rib 3350 forms a protrusion 3352 that faces away from cylinder axis 3390 and a recess 3354 that faces cylinder axis 3390. Rib 3350 encircles cylinder axis 3390.

Figure 34:
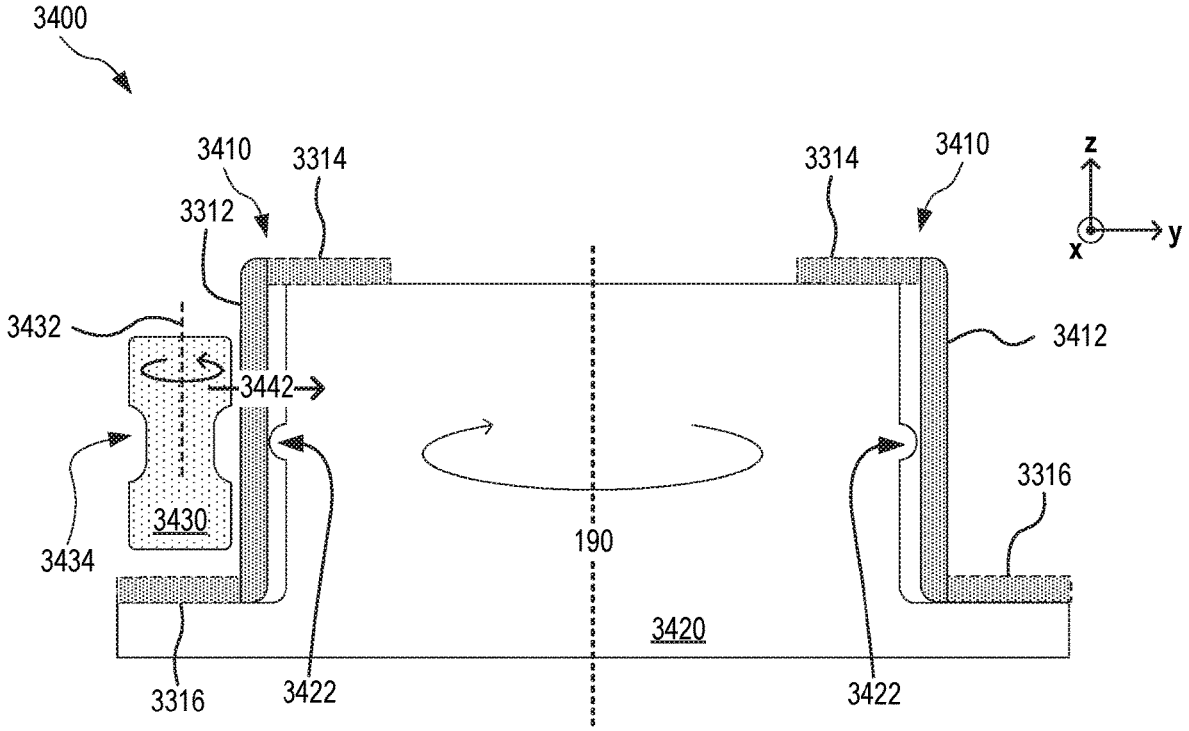
FIG. 34 illustrates a roll-forming method for forming a rib in a sidewall of a ring-shaped workpiece, according to an embodiment.

FIG. 34 illustrates one roll-forming method 3400 for forming a rib in a sidewall of a ring-shaped workpiece 3410 to form ring 3300. Workpiece 3410 includes a cylindrical sidewall 3412 (similar to sidewall 2912). Workpiece 3410 may further include lip 3314 (similar to lip 2814) and/or flange 3316 (similar to flange 2816) respectively connected with the upper and lower ends of sidewall 3412. Workpiece 3410 may be an embodiment of workpiece 110 formed by method 500, or an embodiment of workpiece 110 prior to multi-axis roll-forming according to steps 510, 520, and 530. In the latter case, method 3400 may be implemented as an embodiment of steps 510 and 520 of method 500. Alternatively, workpiece 3410 is not an embodiment of workpiece 110.

Method 3400 spins workpiece 3410 on a spin platter 3420 that spins about rotation axis 190. Spin platter 3420 has a radial protrusion 3422 that encircles rotation axis 190. While workpiece 3410 spins, method 3400 presses a roller 3430 against sidewall 3412, as indicated by arrow 3442. When roller 3430 is in contact with spinning workpiece 3410, roller 3430 rotates about a rotation axis 3432. Roller 3430 has a thinner section 3434 that encircles rotation axis 2432. Pressure from roller 3430 and protrusion 3422 onto sidewall 3412 forms rib 3350 in sidewall 3412. Method 3400 thereby produces ring 3300 having sidewall 3312 with rib 3350.

Method 3400 may be implemented in method 500 as at least a part of steps 510 and 520. Furthermore, method 3400 may be performed by an embodiment of system 100 that (a) implements spin platter 3420 as spin platter 120 and (b) implements roller 3430 as each of one or more support rollers 130.

Figure 35A:
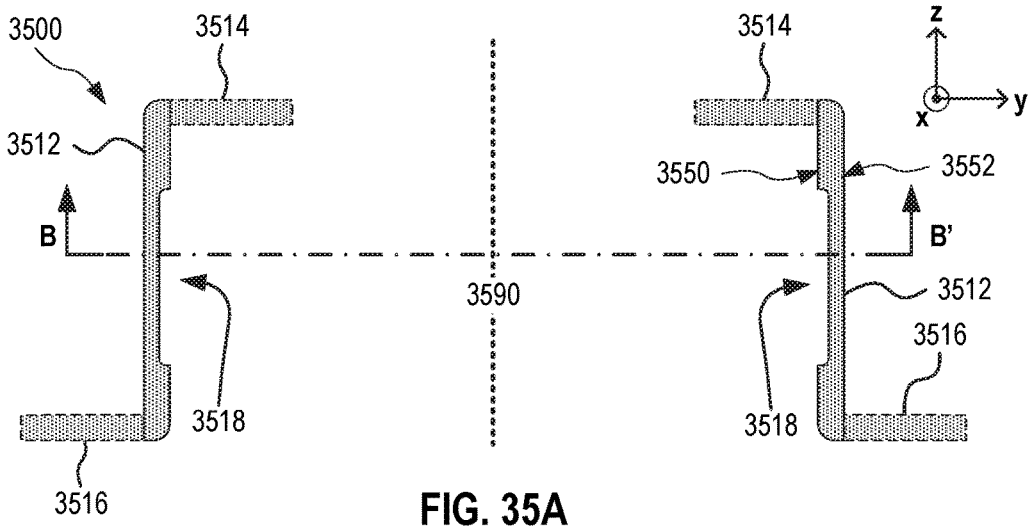
FIGS. 35A and 35B illustrate a ring having a plurality of locally thinned regions arranged at different locations about the cylinder axis of the ring, according to an embodiment.
Figure 35B:
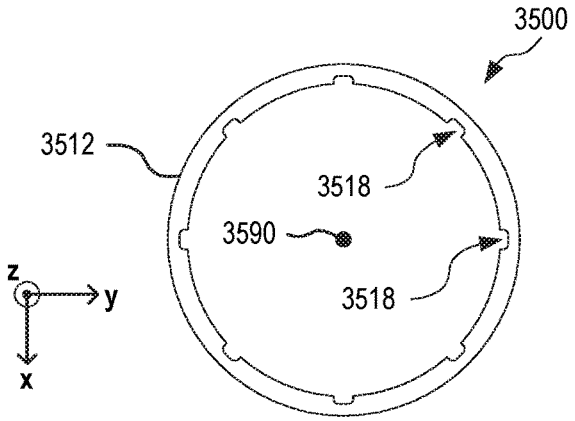

FIGS. 35A and 35B illustrate one ring 3500 having a plurality of locally thinned regions arranged at different locations about the cylinder axis 3590 of ring 3500. FIG. 35A is a cross section of ring 3500 taken in a plane that contains cylinder axis 3590. FIG. 35B is cross section of ring 3500 taken in a plane that is perpendicular to cylinder axis 3590, as indicated by line BB' in FIG. 35A. FIGS. 35A and 35B are best viewed together in the following description.

Ring 3500 encircles a cylinder axis 3590. Ring 3500 includes a cylindrical sidewall 3512 extending along a section of cylinder axis 3590. Ring 3500 may further include a lip 3514 extending from a top end of sidewall 3512 toward cylinder axis 3590, and/or a flange 3516 extending from a bottom end of sidewall 3512 away from cylinder axis 3590. The radially-inward-facing surface 3550 of sidewall 3512 forms a plurality of recesses 3518 positioned at a plurality of azimuthal locations relative to cylinder axis 3590. The radially-outward-facing surface 3552 of sidewall 3512 is cylindrical. Consequently, sidewall 3512 is thinner in the regions associated with recess 3518 than elsewhere. Apart from recesses 3118, ring 3500 is symmetric with respect to rotation about cylinder axis 3590. For clarity of illustration, not all recesses are labeled in FIG. 35B. Without departing from the scope hereof, ring 3500 may include more or fewer recesses than shown in FIG. 35B. In addition, the recesses may be non-uniformly spaced apart from each other, without departing from the scope hereof.

Figure 36A:
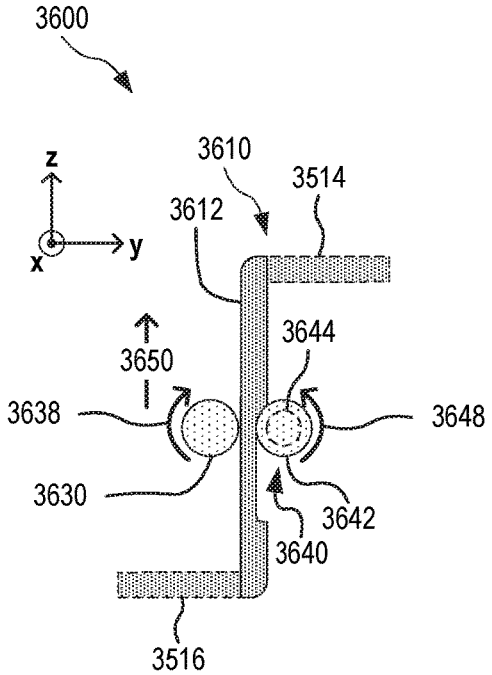
FIGS. 36A and 36B illustrate a roll-forming method for forming a plurality of locally thinned regions in a sidewall of a ring-shaped workpiece, according to an embodiment.
Figure 36B:
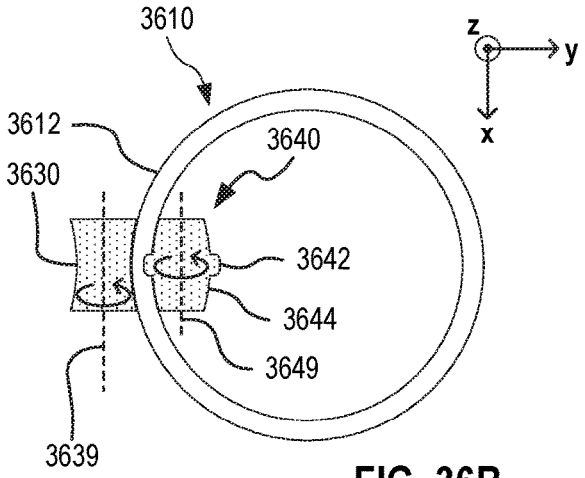

FIGS. 36A and 36B illustrate one roll-forming method 3600 for forming a plurality of locally thinned regions in a sidewall of a ring-shaped workpiece 3610 to form ring 3500. FIG. 36A is a cross section of workpiece 3610 while being modified by method 3600. The view used in FIG. 36A is equivalent to the left half of FIG. 35A. FIG. 36B is another cross section of workpiece 3610 while being modified by method 3600. The view used in FIG. 36B is equivalent to that used in FIG. 35B. FIGS. 36A and 36B are best viewed together in the following description.

Workpiece 3610 includes a cylindrical sidewall 3612 (similar to sidewall 2912). Workpiece 3610 may further include lip 3514 (similar to lip 2814) and/or flange 3516 (similar to flange 2816) respectively connected with the upper and lower ends of sidewall 3612. Workpiece 3610 may be an embodiment of workpiece 110 formed by method 500. Method 3600 may be implemented as at least a part of step 550 of method 500. Alternatively, workpiece 3610 is not an embodiment of workpiece 110.

Method 3600 applies a pair of rollers 3630 and 3640 to sidewall 3612 at each location to be thinned. Roller 3630 is positioned on the outside of sidewall 3612, and roller 3640 is positioned on the inside of sidewall 3612. For each region to be thinned, method 3600 rolls rollers 3630 and 3640 against opposite sides of the same section of sidewall 3612. Method 3600 rolls both of rollers 3630 and 3640 in the direction indicated by arrow 3650. Alternatively, method 3600 rolls both of rollers 3630 and 3640 in the direction opposite arrow 3650. Roller 3630 rotates (as indicated by arrow 3638) about a rotation axis 3639 that translates in the direction of arrow 3650 as roller 3630 rolls along the surface of sidewall 3612. The radially-outward-facing surface of roller 3630, relative to rotation axis 3639 is concave to substantially match the cylindrical curvature of sidewall 3612. Roller 3640 rotates (as indicated by arrow 3648) about a rotation axis 3649 that translates in direction of arrow 3650 as roller 3640 rolls along the surface of sidewall 3612. The radially-outward-facing surface of the main body 3644 of roller 3640, relative to rotation axis 3649 is generally convex to substantially match the cylindrical curvature of sidewall 3612. However, roller 3640 also has a protruding ring 3642 that encircles rotation axis 3649. When method 3600 rolls rollers 3630 and 3640 together as shown in FIGS. 36A and 36B, protruding ring 3642 forms a recess 3518. Method 3600 repeats this process for each desired instance of recess 3518, to form ring 3500.

Figure 37A:
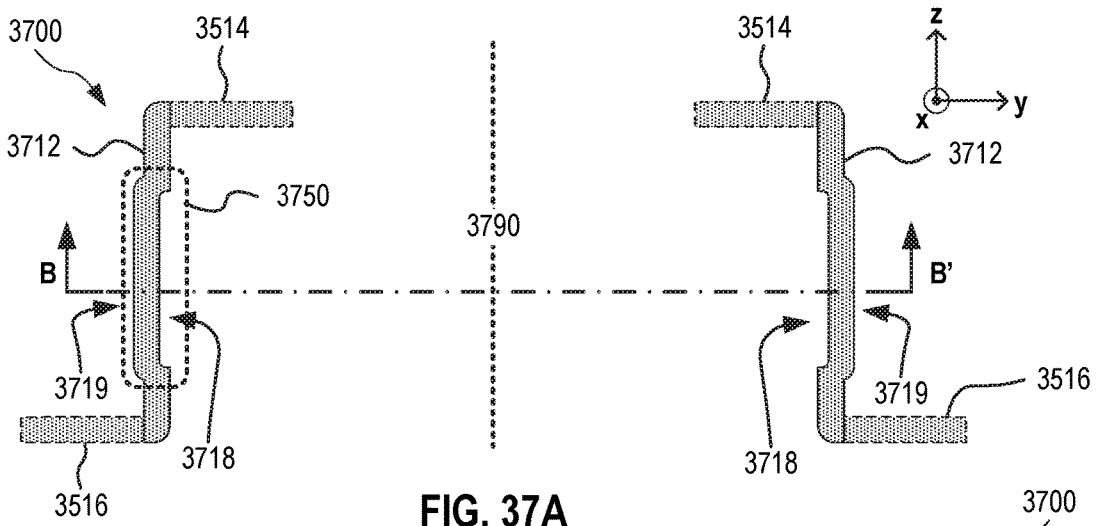
FIGS. 37A and 37B illustrate a ring having a plurality of ribs arranged at different locations about the cylinder axis of the ring, according to an embodiment.
Figure 37B:
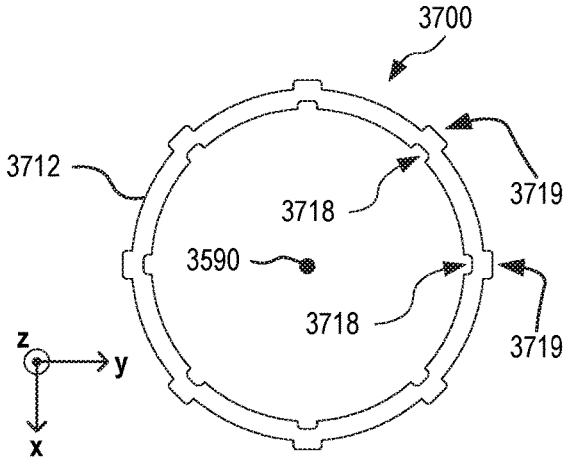

FIGS. 37A and 37B illustrate one ring 3700 having a plurality of ribs arranged at different locations about the cylinder axis 3790 of ring 3700. FIG. 37A is a cross section of ring 3700 taken in a plane that contains cylinder axis 3790. FIG. 37B is cross section of ring 3700 taken in a plane that is perpendicular to cylinder axis 3790, as indicated by line BB' in FIG. 37A. FIGS. 37A and 37B are best viewed together in the following description. Ring 3700 is similar to ring 3500, except that each recess 3518 is replaced by a rib 3750. Each rib 3750 forms a recess 3718 facing cylinder axis 3590, and a protrusion 3719 facing away from cylinder axis 3590. For clarity of illustration, not all recesses 3718 and protrusions 3719 are labeled in FIG. 37B.

Figure 38A:
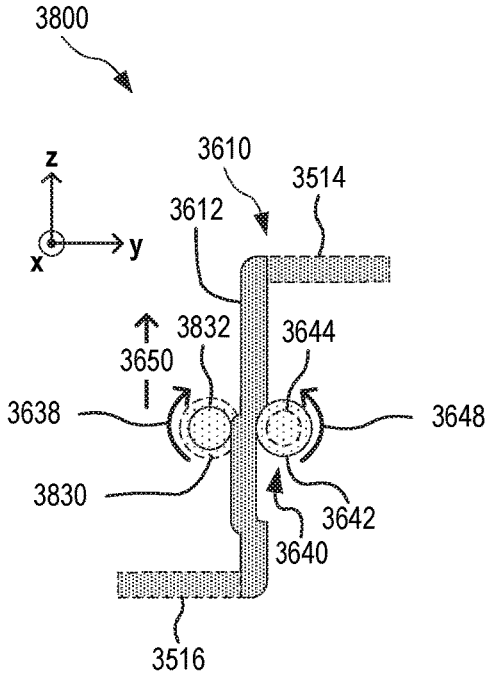
FIGS. 38A and 38B illustrate a roll-forming method for forming a plurality of ribs in a sidewall of a ring-shaped workpiece, according to an embodiment.
Figure 38B:
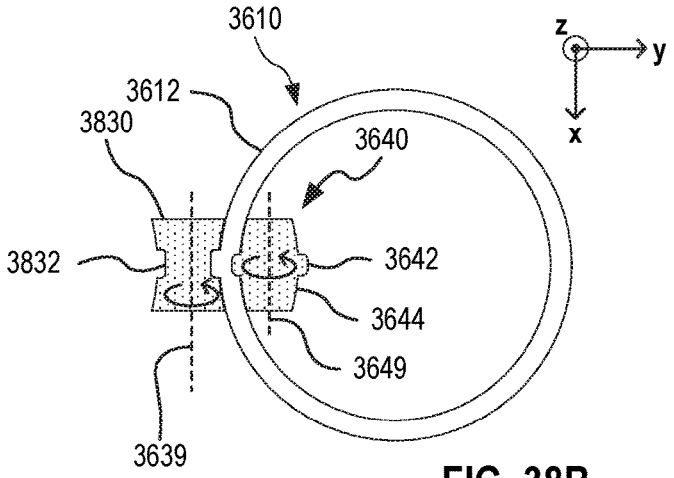

FIGS. 38A and 38B illustrate one roll-forming method 3800 for forming a plurality of ribs in a sidewall of ring-shaped workpiece 3610 to form ring 3700. FIGS. 38A and 38B are orthogonal cross sections of workpiece 3810 while being modified by method 3800. The views used in FIGS. 38A and 38B are equivalent to those used in FIGS. 36A and 36B. FIGS. 38A and 38B are best viewed together in the following description.

Method 3800 is similar to method 3600 except for replacing roller 3630 with a roller 3830. Roller 3830 is similar to roller 3630 except for having a thinner section 3832 in part of its concave, radially-outward-facing surface. Thinner section 3832 encircles rotation axis 3639 of roller 3830. When method 3800 rolls rollers 3830 and 3640, as discussed above for rollers 3630 and 3640 in reference to FIGS. 36A and 36B, protruding ring 3642 and thinner section 3832 cooperate to form rib 3750. Method 3800 repeats this process for each desired instance of rib 3750, to form ring 3700.

Combinations of Features

Features described above as well as those claimed below may be combined in various ways without departing from the scope hereof. For example, it will be appreciated that aspects of one multi-axis roll-forming method, system, or product, described herein, may incorporate features or swap features of another multi-axis roll-forming method, system, or product described herein. The following examples illustrate some possible, non-limiting combinations of embodiments described above. It should be clear that many other changes and modifications may be made to the methods, products, and systems herein without departing from the spirit and scope of this invention:

(A1) One multi-axis roll-forming method includes simultaneously performing steps of (a) spinning, about a rotation axis, a spin platter having placed thereon a ring encircling the rotation axis, (b) pressing at least one first roller against outward-facing surface of a first portion of the ring to press the first portion against an outward-facing surface of the spin platter, and (c) forcing a second roller against an outward-facing surface of a second portion of the ring to bend toward the rotation axis the second portion, so as to form a lip extending toward the rotation axis, wherein the step of forcing includes pivoting the second roller against the second portion, and translating the second roller along the second portion toward the rotation axis.

(A2) In the multi-axis roll-forming method denoted as (A1), the first portion may be associated with a first segment of the rotation axis, and the second portion may be associated with a second segment of the rotation axis.

(A3) In either of the multi-axis roll-forming methods denoted as (A1) and (A2), the step of forcing may include cooperatively performing the steps of pivoting and translating to ensure mono-directional curvature of edge between the first portion and the lip.

(A4) In any of the multi-axis roll-forming methods denoted as (A1) through (A3), the step of forcing may include cooperatively performing the steps of pivoting and translating to ensure that edge between the first portion and the lip does not extend beyond the lip in direction away from the first portion along the rotation axis.

(A5) In the multi-axis roll-forming method denoted as (A4), the spin platter may have a top surface perpendicular to the rotation axis, and the step of cooperatively performing the steps of pivoting and translating may include shaping the second portion against the top surface such that the lip is perpendicular to the rotation axis.

(A6) In the multi-axis roll-forming method denoted as (A5), the step of forcing may further include cooperatively performing the steps of pivoting and translating to ensure that the edge does not extend to greater distance from the rotation axis than original shape of the first portion.

(A7) In any of the multi-axis roll-forming methods denoted as (A1) through (A6), the step of forcing may include simultaneously performing said pivoting and said translating.

(A8) In any of the multi-axis roll-forming methods denoted as (A1) through (A6), the step of forcing may include alternatingly performing an increment of said pivoting and an increment of said translating.

(A9) In any of the multi-axis roll-forming methods denoted as (A1) through (A6), the step of forcing may include completing the step of pivoting prior to initiating the step of translating.

(A10) In the multi-axis roll-forming method denoted as (A9), the spin platter may have a top surface perpendicular to the rotation axis, and the step of forcing may include (i) in the step of pivoting, positioning surface of the second roller, contacting the second portion, at an oblique angle to the rotation axis, and (ii) in the step of translating, translating the second roller along direction perpendicular to the rotation axis, to shape the second portion against the top surface such that the lip is perpendicular to the rotation axis.

(A11) In any of the multi-axis roll-forming methods denoted as (A1) through (A9), the spin platter may have a top surface perpendicular to the rotation axis, and the step of pivoting may include pivoting the second roller to an angle where surface of the second roller, contacting the second portion, is perpendicular to the rotation axis, such that the lip is perpendicular to the rotation axis.

(A12) In the multi-axis roll-forming method denoted as (A11), the spin platter may be cylindrical along the first segment of the rotation axis, the first portion of the ring may be parallel to the rotation axis, and the step of forcing may include forming a ninety-degree bend between the first portion and the second portion.

(A13) In any of the multi-axis roll-forming methods denoted as (A1) through (A12), the step of forcing may include forming the lip with uniform material thickness.

(A14) In any of the multi-axis roll-forming methods denoted as (A1) through (A13), the step of forcing may include cooperatively performing the steps of pivoting and translating to form the lip with no keystone effect or with keystone effect less than ten percent of minimum material thickness of the lip.

(A15) In any of the multi-axis roll-forming methods denoted as (A1) through (A13), the step of forcing may include cooperatively performing the steps of pivoting and translating to form the lip with increasing material thickness in direction toward the rotation axis.

(A16) In any of the multi-axis roll-forming methods denoted as (A1) through (A15), the step of forcing may include extruding material of the second portion.

(A17) The multi-axis roll-forming method denoted as (A16) may include, after forming the lip, trimming the lip to expand diameter of aperture defined by the lip.

(A18) Any of the multi-axis roll-forming methods denoted as (A1) through (A17) may include, after forming the lip, reapplying the second roller to the second portion to thin, by translation of the second roller from outer diameter of the lip partway to inner diameter of the lip, material thickness of the lip in a larger-diameter range.

(A19) In any of the multi-axis roll-forming methods denoted as (A1) through (A12), the second roller may include a first cylinder of a first diameter and a second cylinder of a second diameter that is smaller than the first diameter, wherein the first cylinder is closer than the second cylinder to the first portion during the step of forcing, and the step of forcing may include forming the lip with (i) a first material thickness, defined by the first diameter, in section of the lip located at greater distance from the rotational axis than a first radius and (ii) a second material thickness, defined by the second diameter in a region located at smaller distance from the rotation axis than a second radius, wherein the second radius is no greater than the first radius and the second material thickness is greater than the first material thickness.

(A20) Any of the multi-axis roll-forming methods denoted as (A1) through (A19) may include sequentially processing a plurality of instances of the ring at a throughput of at least one ring per minute, wherein the step of sequentially processing includes, for each ring, using the spin platter, the at least one first roller, and the second roller to perform the steps of spinning, pressing, and forcing.

(A21) Any of the multi-axis roll-forming methods denoted as (A1) through (A20) may further include roll-forming the ring from a metal sheet, wherein the step of roll-forming includes bending the metal sheet to contact two opposite ends of the metal sheet to each other and welding the two opposite ends together.

(B1) One ring produced by multi-axis roll-forming includes (a) a sidewall encircling a cylinder axis of the ring, the sidewall having height along the cylinder axis from a bottom end of the sidewall to a top end of the sidewall, (b) a lip encircling and extending toward the cylinder axis to define an aperture of smaller diameter than the top end, the lip having a bottom surface facing space enclosed by the sidewall, the bottom surface being planar or conical, and (c) an edge connecting the lip and the top end, wherein (i) the ring has mono-directional curvature from the top end, around the edge, and along at least a portion of the lip, and (ii) the sidewall, the lip, and the edge are respective portions of a single continuous part.

(B2) In the ring denoted as (B1), extent of the edge along the cylinder axis may be bounded by extent, along the cylinder axis, between the top end and top of the lip.

(B3) Either of the rings denoted as (B1) and (B2) may further include a weld seam extending from the bottom end to the aperture.

(B4) In any of the rings denoted as (B1) through (B3), material thickness of the lip may deviate from material thickness of the sidewall by no more than 10 percent.

(B5) In any of the rings denoted as (B1) through (B3), the lip may have uniform material thickness.

(B6) In the ring denoted as (B5), the uniform material thickness may deviate from material thickness of the sidewall by no more than 10 percent.

(B7) In the ring denoted as (B5), the uniform material thickness may be less than material thickness of the sidewall.

(B8) In any of the rings denoted as (B1) through (B3), material thickness of the lip at the aperture may be greater than material thickness of the lip adjacent the edge.

(B9) In the ring denoted as (B8), material thickness of the lip may increase linearly from the edge to the aperture.

(B10) In the ring denoted as (B8), material thickness of the lip may undergo at least one stepwise increase between the edge and the aperture.

(B11) In any of the rings denoted as (B1) through (B10), the sidewall may be parallel to the cylinder axis, and the lip may be perpendicular to the cylinder axis.

(C1) One multi-axis roll-forming system includes (a) a spin platter that is (i) configured to spin about a rotation axis while holding a workpiece and (ii) has an outward-facing surface, facing away from the rotation axis, and a top surface characterized by a surface normal that is parallel to the rotation axis or at an oblique angle to the rotation axis, (b) at least one support roller positioned radially outward from the outward-facing surface, wherein each support roller is configured to press a first portion of the workpiece against the outward-facing surface, and (c) a form roller configured to pivot toward the top surface and translate parallel to the top surface, to bend a second portion of the workpiece against the top surface while the spin platter is spinning the workpiece.

(C2) In the multi-axis roll-forming system denoted as (C1), the form roller may have a work surface configured to press against the second portion to bend the second portion against the top surface, and the form roller may be configured to translate across a linear range such that a segment of the work surface closest to the second portion is capable of translating at least between (i) a first distance from the rotation axis that, in absence of pivoting of the form roller, exceeds radius of the spin platter and (ii) a second distance that, in absence of pivoting of the form roller, is less than the radius.

(C3) In the multi-axis roll-forming system denoted as (C2), the form roller may be configured to pivot across an angle range such that segment of the work surface, closest to the workpiece, is capable of pivoting at least between (I) a first orientation parallel with the outward-facing surface and (II) a second orientation parallel with the top surface.

(C4) In the multi-axis roll-forming system denoted as (C2), the work surface may be cylindrical, and each support roller may have a cylindrical support surface configured to press against the workpiece to press the workpiece against the outward-facing surface.

(C5) In any of the multi-axis roll-forming systems denoted as (C1) through (C4), the at least one support roller may include two support rollers at two different azimuthal positions relative to the rotation axis, and the form roller may be at an azimuthal position between the two different azimuthal positions.

(C6) Any of the multi-axis roll-forming systems denoted as (C1) through (C5) may further include a swing arm having the form roller mounted thereto, a table supporting the swing arm and configured to translate the swing arm in direction parallel to the top surface to translate the form roller parallel to the top surface, and (f) a rotation joint between the swing arm and the table to facilitate pivoting of the swing arm relative to the table, to pivot the form roller toward the top surface.

(C7) The multi-axis roll-forming system denoted as (C8) may further include a first actuator for driving the table to translate the swing arm in the direction parallel to the top surface, a second actuator for driving said pivoting of the swing arm, and a controller for commanding the first actuator and the second actuator to cooperatively translate and pivot the form roller to ensure mono-directional curvature of edge between the first portion and the second portion.

(C8) The multi-axis roll-forming system denoted as (C8) may further include a first actuator for driving the table to translate the swing arm in the direction parallel to the top surface, a second actuator for driving said pivoting of the swing arm, and a controller for commanding the first actuator and the second actuator to cooperatively translate and pivot the form roller to ensure that edge between the first portion and the second portion neither extends beyond the lip in direction away from the first portion along the rotation axis nor extends to greater distance from the rotation axis than original shape of the first portion.

Changes may be made in the above systems, methods, and workpieces without departing from the scope hereof. It should thus be noted that the matter contained in the above description and shown in the accompanying drawings should be interpreted as illustrative and not in a limiting sense. The following claims are intended to cover generic and specific features described herein, as well as all statements of the scope of the present systems and methods, which, as a matter of language, might be said to fall therebetween.

The invention claimed is:

1. A multi-axis roll-forming method, comprising simultaneously performing steps of:

spinning, about a rotation axis, a spin platter having placed thereon a ring encircling the rotation axis;

pressing at least one first roller against outward-facing surface of a first portion of the ring to press the first portion against an outward-facing surface of the spin platter; and forcing a second roller against an outward-facing surface of a second portion of the ring to bend toward the rotation axis the second portion, so as to form a lip extending toward the rotation axis, said forcing including (i) pivoting the second roller around a pivot axis while forcing the second roller against the second portion, and (ii) translating the pivot axis of the second roller toward the rotation axis while forcing the second roller against the second portion.

2. The multi-axis roll-forming method of claim 1, the first portion being associated with a first segment of the rotation axis, and the second portion being associated with a second segment of the rotation axis.

3. The multi-axis roll-forming method of claim 1, the step of forcing comprising cooperatively performing the steps of pivoting and translating to ensure mono-directional curvature of an edge between the first portion and the lip.

4. The multi-axis roll-forming method of claim 1, the step of forcing comprising cooperatively performing the steps of pivoting and translating to ensure that an edge between the first portion and the lip does not extend beyond the lip in a direction away from the first portion along the rotation axis.

5. The multi-axis roll-forming method of claim 4, the spin platter having a top surface perpendicular to the rotation axis, the step of cooperatively performing the steps of pivoting and translating comprising shaping the second portion against the top surface such that the lip is perpendicular to the rotation axis.

6. The multi-axis roll-forming method of claim 5, the step of forcing further comprising cooperatively performing the steps of pivoting and translating to ensure that the edge does not extend to a greater distance from the rotation axis than an original shape of the first portion.

7. The multi-axis roll-forming method of claim 1, the step of forcing comprising alternatingly performing an increment of said pivoting and an increment of said translating.

8. The multi-axis roll-forming method of claim 1, the step of forcing comprising completing the step of pivoting prior to initiating the step of translating.

9. The multi-axis roll-forming method of claim 8, the spin platter having a top surface perpendicular to the rotation axis, the step of forcing comprising:

in the step of pivoting, pivoting the surface of the second roller, contacting the second portion, around the pivot axis to form an oblique angle to the rotation axis; and in the step of translating, translating the pivot axis of the second roller along a direction perpendicular to the rotation axis, to shape the second portion against the top surface such that the lip is perpendicular to the rotation axis.

10. The multi-axis roll-forming method of claim 1, the spin platter having a top surface perpendicular to the rotation axis, the step of pivoting comprising pivoting the second roller to an angle where a surface of the second roller, contacting the second portion, is perpendicular to the rotation axis, such that the lip is perpendicular to the rotation axis.

11. The multi-axis roll-forming method of claim 10, the spin platter being cylindrical along the first segment of the rotation axis, the first portion of the ring being parallel to the rotation axis, the step of forcing comprising forming a ninety-degree bend between the first portion and the second portion.

12. The multi-axis roll-forming method of claim 1, the step of forcing comprising forming the lip with uniform material thickness.

13. The multi-axis roll-forming method of claim 1, the step of forcing comprising cooperatively performing the steps of pivoting and translating to form the lip with no keystone effect or with keystone effect less than ten percent of minimum material thickness of the lip.

14. The multi-axis roll-forming method of claim 1, the step of forcing comprising cooperatively performing the steps of pivoting and translating to form the lip with increasing material thickness in direction toward the rotation axis.

15. The multi-axis roll-forming method of claim 1, the step of forcing comprising extruding material of the second portion.

16. The multi-axis roll-forming method of claim 15, comprising, after forming the lip, trimming the lip to expand diameter of aperture defined by the lip.

17. The multi-axis roll-forming method of claim 1, comprising, after forming the lip, reapplying the second roller to the second portion to thin, by translation of the second roller from outer diameter of the lip partway to inner diameter of the lip, material thickness of the lip in a larger-diameter range.

18. The multi-axis roll-forming method of claim 1, the second roller including a first cylinder of a first diameter and a second cylinder of a second diameter that is smaller than the first diameter, the first cylinder being closer than the second cylinder to the first portion during the step of forcing, the step of forcing comprising forming the lip with (i) a first material thickness, defined by the first diameter, in section of the lip located at greater distance from the rotational axis than a first radius and (ii) a second material thickness, defined by the second diameter in a region located at smaller distance from the rotation axis than a second radius, the second radius being no greater than the first radius, the second material thickness being greater than the first material thickness.

19. The multi-axis roll-forming method of claim 1, comprising sequentially processing a plurality of instances of the ring at a throughput of at least one ring per minute, the step of sequentially processing including, for each ring, using the spin platter, the at least one first roller, and the second roller to perform the steps of spinning, pressing, and forcing.

20. The multi-axis roll-forming method of claim 1, further comprising roll-forming the ring from a metal sheet, the step of roll-forming including:

bending the metal sheet to contact two opposite ends of the metal sheet to each other; and welding the two opposite ends together.

* * * * *